US007033011B2

(12) United States Patent
Murakami et al.

(10) Patent No.: US 7,033,011 B2
(45) **Date of Patent: *Apr. 25, 2006**

(54) INK CARTRIDGE, PRINTING APPARATUS USING THE INK CARTRIDGE, AND METHOD FOR DETECTING REMAINING AMOUNT OF INK USING THE INK CARTRIDGE

(75) Inventors: Atsushi Murakami, Nagoya (JP); Masatoshi Yoshiyama, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/101,447

(22) Filed: Apr. 8, 2005

(65) Prior Publication Data

US 2005/0179755 A1 Aug. 18, 2005

Related U.S. Application Data

(63) Continuation of application No. 10/614,126, filed on Jul. 8, 2003, now Pat. No. 6,893,118, which is a continuation of application No. 10/108,394, filed on Mar. 29, 2002, now Pat. No. 6,616,255.

(30) Foreign Application Priority Data

Mar. 30, 2001 (JP) ..... 2001-102423

(51) Int. Cl.
*B41J 2/175* (2006.01)
*B41J 29/393* (2006.01)

(52) U.S. Cl. ..... 347/86; 347/19

(58) Field of Classification Search ..... 347/2, 347/5, 7, 19, 68, 84, 85, 86, 87
See application file for complete search history.

(56) References Cited

U.S. PATENT DOCUMENTS 5,936,645 A 8/1999 Niikura et al.

(Continued)

FOREIGN PATENT DOCUMENTS

JP A 2-102062 4/1990

(Continued)

*Primary Examiner*—Anh T. N. Vo
(74) *Attorney, Agent, or Firm*—Oliff & Berridge, PLC

(57) ABSTRACT

The invention relates to an ink cartridge wherein a remaining amount of ink can be detected using an optical sensor. The ink cartridge has a window, for detection of an ink remaining amount, that is inclined at a predetermined angle with respect to the vertical direction. Inside of the ink cartridge, a preventive member is vertically provided. When the ink level is up to the window, light irradiated from the optical sensor permeates the window. Then, the light passes through the ink and reaches the preventive member. Preferably, the window is inclined approximately 20 degrees with respect to the preventive member. Accordingly, an incident angle of the light that has reached the preventive member is different from an incident angle of the light to the window. Thus, most of the light that has reached the preventive member is absorbed or is reflected by the preventive member in a direction different from the incident direction, so that the light reflected toward the optical sensor can be restricted. When the ink level is not up to the window, the light irradiated from the optical sensor is reflected at an inner surface of the inclined portion, and travels toward the optical sensor. Consequently, the remaining amount of the ink is detected based on the amount of the reflected light. With this structure, detection accuracy of the amount of ink remaining in the ink cartridge can be improved.

26 Claims, 16 Drawing Sheets

U.S. PATENT DOCUMENTS

| | | | | |
|---|---|---|---|---|
| 6,270,207 | B1 | 8/2001 | Sasaki | |
| 6,616,255 | B1 | 9/2003 | Murakami et al. | |
| 6,893,118 | B1 * | 5/2005 | Murakami et al. | 347/84 |
| 2001/0024226 | A1 | 9/2001 | Sasaki | |
| 2003/0030707 | A1 | 2/2003 | Sasaki | |
| 2003/0048339 | A1 | 3/2003 | Sasaki | |

FOREIGN PATENT DOCUMENTS

| | | |
|---|---|---|
| JP | A 10-232157 | 9/1998 |
| JP | A 2000-71472 | 3/2000 |

* cited by examiner

FIG.7 (DETECTION OF DEVIATION OF RELATIVE POSITION BETWEEN INK SENSOR AND CARTRIDGE)

RELATED ART FIG.16A
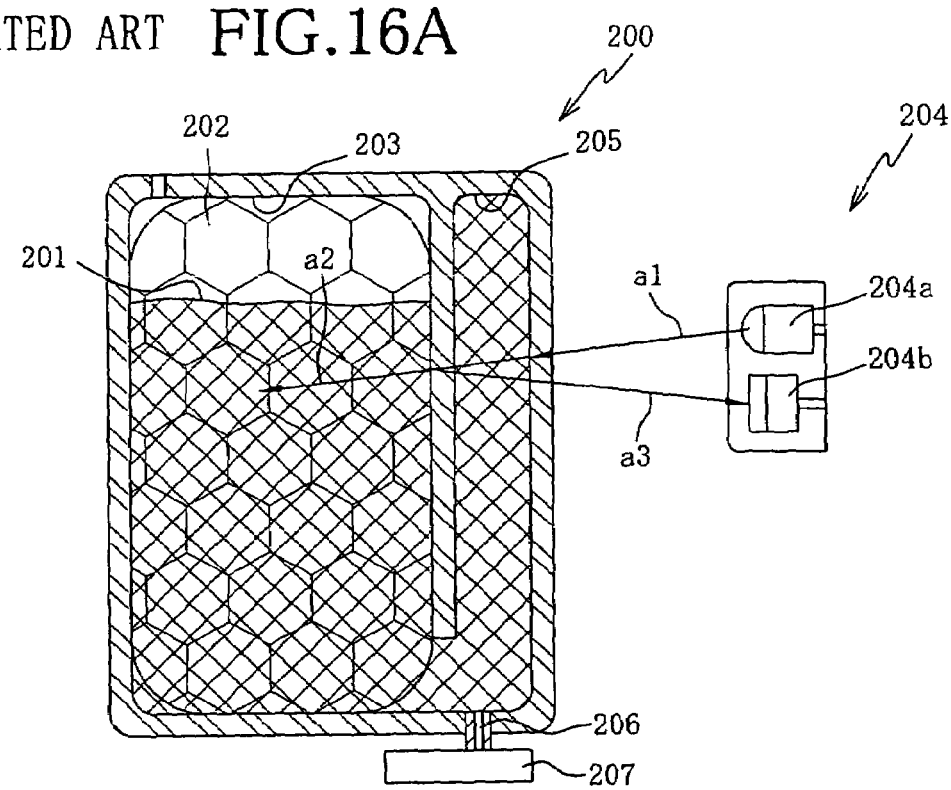
RELATED ART FIG.16B
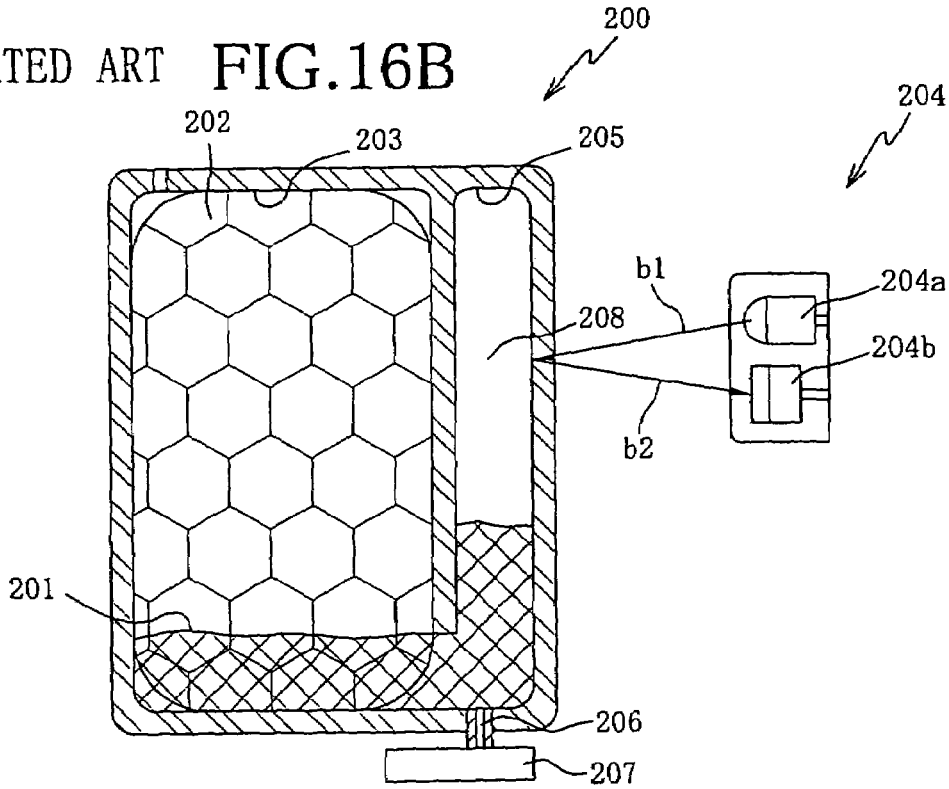

INK CARTRIDGE, PRINTING APPARATUS USING THE INK CARTRIDGE, AND METHOD FOR DETECTING REMAINING AMOUNT OF INK USING THE INK CARTRIDGE

This is a Continuation of application Ser. No. 10/614,126 filed Jul. 8, 2003 now U.S. Pat. No. 6,893,118, which in turn is a Continuation of application Ser. No. 10/108,394 filed Mar. 29, 2002 now U.S. Pat. No. 6,616,255. The entire disclosures of the prior applications are hereby incorporated by reference herein in their entireties.

BACKGROUND OF THE INVENTION

1. Field of Invention

The invention relates to an ink cartridge to be used in printing apparatuses, such as printers, copy machines, and facsimile machines. More particularly, the invention pertains to an ink cartridge wherein detection accuracy of an ink remaining amount in the ink cartridge using an optical device can be improved.

2. Description of Related Art

There has been provided ink cartridges, used in printers or the like, that are structured so that ink level in the ink cartridges can be detected using an optical device. In the ink cartridge of this type, generally, ink is stored in a light-permeable case. The ink level is detected through the use of change in an amount of reflected light caused in accordance with the ink level, by which light is irradiated into the ink cartridge from a light source.

FIGS. 16A and 16B show a principle of detection of the presence or absence of ink in a conventional ink cartridge 200. As shown in FIGS. 16A and 16B, the ink cartridge 200 is molded using a light-permeable material (e.g. resin materials, such as polypropylene), and includes a main ink tank 203 that accommodates therein a foam (porous material) 202 capable of impregnating ink 201 and a sub-ink tank 205 to which light is applied from an ink sensor 204. The ink 201 is stored in both main and sub-ink tanks 203, 205. An ink jet head 207 is connected to the bottom of the ink cartridge 200 via an ink supply hole 206. The ink 201 is supplied from the ink cartridge 200 through the ink supply hole 206 and is ejected from the ink jet head 207. As a result, an image can be obtained on a recording medium.

In the ink cartridge 200, first, the ink 201 in the main ink tank 203 is gradually consumed (see FIG. 16A). After the ink 201 in the main ink tank 203 nearly runs out, the ink 201 in the sub-ink tank 205 is used (see FIG. 16B). The ink sensor 204 includes a light-emitting device 204*a* that irradiates infrared light toward the ink cartridge 200 and a photoreceptor device 204*b* that receives light reflected from the ink cartridge 200. The ink sensor 204 is disposed so as to be able to irradiate the infrared light toward the sub-ink tank 205.

As shown in FIG. 16A, when the ink cartridge 200 contains a large amount of ink (when the ink cartridge 200 contains the ink 201 in both the main and sub-ink tanks 203, 205), infrared light irradiated from the light-emitting device 204*a* of the ink sensor 204 (an optical path a1) travels in the ink cartridge 200 in a direction indicated with an optical path a2 while permeating the ink 201, because a refractive index of the material forming the ink cartridge 200 is close to a refractive index of the irk 201. Therefore, the infrared light is absorbed by the ink 201, so that an extremely small amount of the light is to be reflected from the inside of the ink cartridge 200 toward the photoreceptor device 204*b* in the ink sensor 204. Even when the photoreceptor device 204*b* receives such the amount of the reflected light, it is not determined that the ink is absent.

As opposed to this, as shown in FIG. 16B when the ink 201 is absent at the upper area of the sub-ink tank 205 of the ink cartridge 200, the infrared light irradiated from the light-emitting device 204*a* in the ink sensor 204 (an optical path b1) is reflected at a phase boundary between air 208 and an inner surface of an outer wall of the sub-ink tank 205 (an optical path b2), because the refractive index of the material forming the ink cartridge 200 is different from a refractive index of the air 208. Accordingly, a large amount of the light is reflected from the inside of the ink cartridge 200 toward the photoreceptor device 204*b* in the ink sensor 204. Accordingly, the photoreceptor device 204*b* receives the large amount of the reflected light, so that it is determined that the ink is absent.

As described above, the amount of the light to be reflected from the ink cartridge 200 changes in accordance with the presence or absence of the ink 201 at a predetermined level in the sub-ink tank 205. Therefore, a remaining amount of the ink 201 in the ink cartridge 200 can be detected by which a difference of the reflected light amount between the presence of the ink 201 and the absence of the ink 201 is detected using the photoreceptor device 204*b* in the ink sensor 204.

When the ink cartridge 200 contains a certain level of the ink 201 (when the level of ink 201 in the sub-ink tank 205 is up to the upper area of the sub-ink tank 205 although the ink 201 in the main ink tank 203 almost runs out (not shown)), the ink 201 is not absorbed in the foam 202. Therefore, infrared light irradiated from the light-emitting device 204*a* in the ink sensor 204 (an optical path a1) is reflected by the inner wall of the main ink tank 203 or the foam 202 (an optical path a3).

In this case, when the ink cartridge 200 contains intensely colored ink, such as black and cyan ink, a certain amount of the infrared light irradiated from the light-emitting device 204*a* in the ink sensor 204 (the optical path a1) is absorbed by the foam 202. Thus, an amount of reflected light that cannot be determined as the absence of ink, is reflected from the ink cartridge 200 toward the photoreceptor device 204*b* in the ink sensor 204.

However, when the ink cartridge 200 contains light-colored ink, such as yellow and magenta ink, a problem occurs that an amount of ink remaining in the ink cartridge 200 cannot be correctly detected. That is, the infrared light is hardly absorbed by light-colored ink, so that the infrared light that travels in the ink cartridge 200 containing the light-colored ink is reflected by the foam 202. Thus, the photoreceptor device 204*b* would receive a large amount of the reflected light (the optical path a3 in FIG. 16A) though the ink cartridge 200 contains the ink 201 in both main and sub-ink tanks 203, 205. Therefore, the difference of the reflected light amount between the presence and the absence of the ink 201 at the predetermined level in the sub-ink tank 205 is small, so that the amount of the ink 201 remaining in the ink cartridge 200 cannot be precisely detected.

SUMMARY OF THE INVENTION

The invention provides an ink cartridge wherein detection accuracy of a remaining amount of ink in the ink cartridge using an optical device can be improved.

According to one aspect of the invention, an ink cartridge includes an ink tank that can store ink therein, and is detachable from an image forming apparatus that forms an image using the ink. An ink detection window, permeable to light, is disposed to an outer wall surface of the ink tank. An optical path direction changing member is disposed inside the ink tank, at a predetermined distance away from a surface of the ink detection window that contacts the ink. The optical path direction changing member changes a direction of an optical path of the light that passes through the ink detection window. On the ink cartridge, the ink detection window is inclined at a predetermined angle with respect to the optical path direction changing member.

According to the ink cartridge, when the ink cartridge is attached to the image forming apparatus, the ink stored in the ink tank is supplied to the image forming apparatus. The ink detection window, that is permeable to light, is disposed to the outer wall surface of the ink tank. When the level of ink the ink tank is not up to the ink detection window, light irradiated toward the ink detection window by a light-emitting device provided in the image forming apparatus is reflected at an inner surface of the ink detection window and the reflected light travels toward a photoreceptor provided in the image forming apparatus.

When the level of ink in the ink tank is up to the ink detection window, the light permeates a phase boundary between the ink and the ink detection window. Then, the light travels in the ink tank, passing through the ink, and reaches the optical path direction changing member disposed in the ink tank. The direction of the optical path of the light that reaches the optical path direction changing member is changed by the optical path direction changing member. The ink detection window is inclined at a predetermined angle with respect to the optical path direction changing member, so that an incident angle of the light to the optical path direction changing member is different from an incident angle of the light reflected to the ink detection window. Accordingly, the light that travels toward the photoreceptor provided in the image forming apparatus is regulated.

BRIEF DESCRIPTION OF THE DRAWINGS

Exemplary embodiments of the invention will be described in detail with reference to the following figures wherein:

FIGS. 16A and 16B are sectional views of an ink cartridge for explaining a principal of conventional ink detection.

DETAILED DESCRIPTION OF THE PREFERRED EMBODIMENTS

Exemplary embodiments of the invention will be described with reference to the accompanying drawings. Explanations will be provided using a color ink jet printer 1, as a printing apparatus, that includes four ink cartridges 2 (a black ink cartridge 2*a*, a cyan ink cartridge 2*b*, a magenta ink cartridge 2*c* and an yellow ink cartridge 2*d*), each of which stores a particular color of ink.

Figure 1:
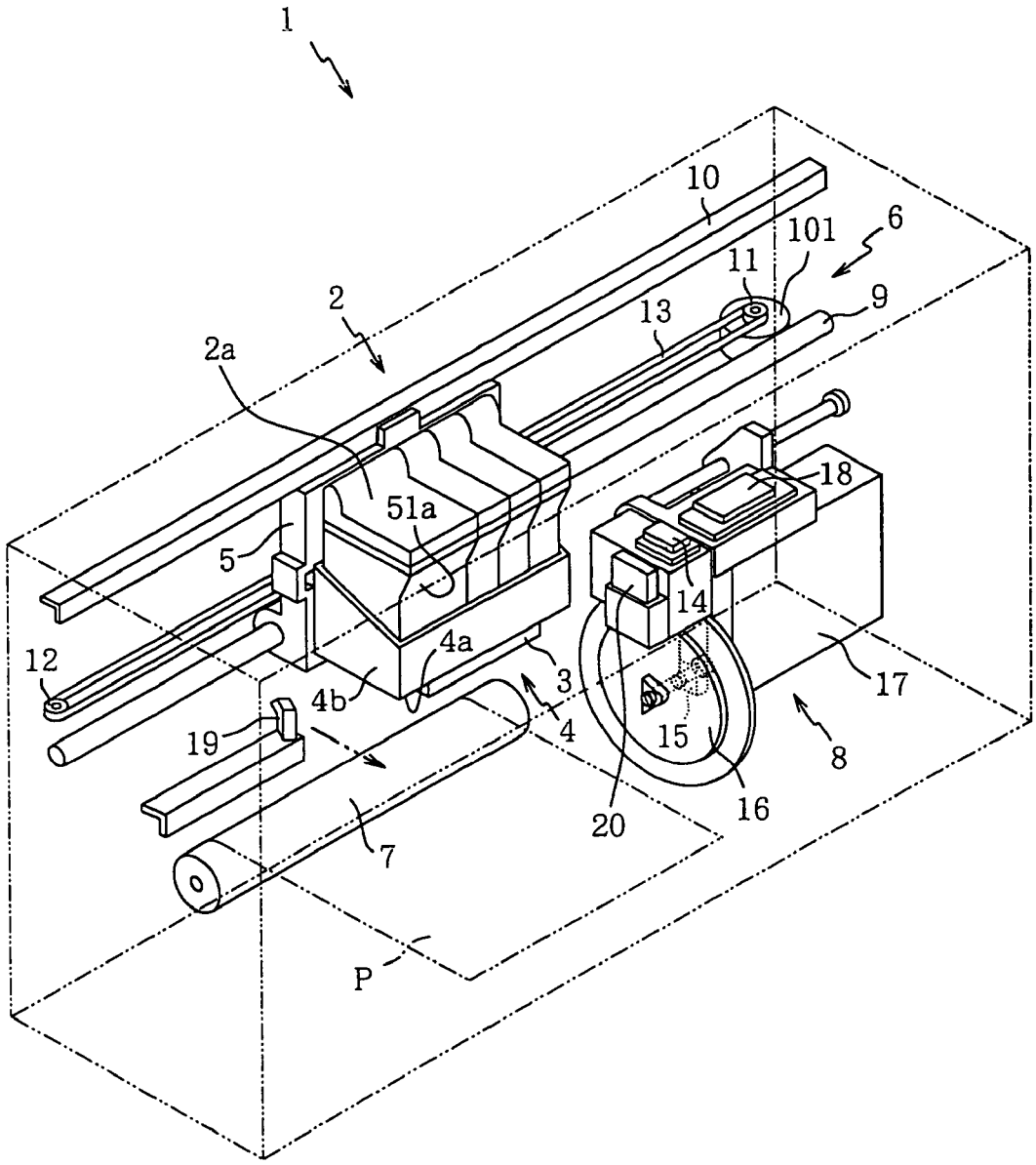
FIG. 1 is a perspective view of a color ink jet printer, to which ink cartridges of a first embodiment of the invention are attached.

As shown in FIG. 1, the color ink jet printer 1 includes an ink sensor 19. The ink sensor 19 is disposed so as to irradiate a surface of the ink cartridge 2 at an angle (the angle of turn of the light-emitting surface of the ink sensor with respect to the ink cartridge is approximately 10 degrees in a horizontal direction) with light in order to reduce noise signals (undesired reflected light) from the irradiated surface of the ink cartridge 2. In the color ink jet printer 1, a controller, that includes a printer control circuit board 100 and a carriage circuit board 120, detects the presence or absence of ink at a predetermined level in the ink cartridge 2 and that of ink cartridge 2 by comparing an amount of reflected light detected by the ink sensor 19 with first and second threshold values. Further, the controller can precisely detect the amount of the reflected light detected by correcting a detection position of the ink cartridge 2. The first threshold value is a reference value to determine whether the reflected light level is within the ink present level or absent level. The second threshold value is a reference value to determine whether the ink cartridge 2 is present or absent.

The color ink jet printer 1 includes the ink cartridges 2, a print head 3, a head unit 4, a carriage 5, a drive unit 6, a platen roller 7, a purge device 8 and the ink sensor 19. The ink cartridges 2 are each filled with a particular color of ink, such as cyan, magenta, yellow and black. The print head 3 performs printing using the color inks on a recording medium P, such as a recording sheet. The print head 3 is provided on the head unit 4. The ink cartridges 2 and the head unit 4 are mounted on the carriage 5. The drive unit 6 reciprocates the carriage 5 in a straight line. The platen roller 7 extends in a carriage reciprocating direction and faces the print head 3.

A pair of side covers 4*b* are provided on both sides of a mounting portion 4*a*, and three partitions 4*c* (see FIG. 2) stand on and extend from the mounting portion 4*a* of the head unit 4. The mounting portion 4*a* is partitioned off for the separate accommodation of the four ink cartridges 2 by the partitions 4*c*. The black ink cartridge 2*a*, the cyan ink cartridge 2*b*, the magenta ink cartridge 2*c* and the yellow ink cartridge 2*d* are mounted on the respective accommodating portion. The black ink cartridge 2*a* has a capacity that is larger than that of the other ink cartridges 2*b*, 2*c*, 2*d*, because the black ink cartridge 2*a* has a high frequency of use.

The drive unit 6 includes a carriage shaft 9, a guide plate 10, two pulleys 11, 12 and an endless belt 13. The carriage shaft 9 is disposed at a lower end of the carriage 5 and extends in a direction parallel to the platen roller 7. The guide plate 10 is disposed at an upper end of the carriage 5 and extends in a direction parallel to the carriage shaft 9. The pulleys 11, 12 are disposed at both ends of the carriage shaft 9, between the carriage 9 and the guide plate 10. The endless belt 13 is stretched between the pulleys 11, 12.

As the pulley 11 is rotated in normal and reverse directions by a carriage motor (CR motor) 101, the carriage 5 is connected to the endless belt 13 and reciprocates in the straight line, along the carriage shaft 9 and the guide plate 10, according to the rotation in the normal and reverse directions of the pulley 11.

The recording medium P is fed from a sheet cassette (not shown) provided in a side or a lower part of the color ink jet printer 1. The recording medium P, fed from the sheet cassette, is fed between the print head 3 and the platen roller 7 to perform printing on the recording medium P by ink droplets ejected from the print head 3. Then, the recording medium P is discharged out of the color ink jet printer 1. In FIG. 1, a sheet feeding mechanism and a discharging mechanism of the recording medium P are omitted.

The purge device 8 is disposed next to the platen roller 7. When the head unit 4 is placed in a reset position, the purge device 8 is opposed to the print head 3. In the reset position, nozzles formed in the head unit 3 are purged and capped to prevent ink from drying. The purge device 8 includes a purge cap 14, a pump 15, a cam 16 and a waste ink reservoir 17. The purge cap 14 contacts a nozzle surface to cover the nozzles (not shown) formed in the print head 3. When the head unit 4 is located in the reset position, the nozzles in the print head 3 are covered with the purge cap 14 to inhale ink and air bubbles trapped in the print head 3 using the pump 15 by the cam 16, thereby purging the print head 3. The inhaled ink are stored in the waste ink reservoir 17.

A wiper 20 is provided adjacent to the purge device 8 on the side of the platen roller 7. The wiper 20 has a paddle-shape, and wipes the nozzle surface of the print head 3 in accordance with movement of the carriage 5. A cap 18 is provided to cover the nozzles in the print head 3 located in the rest position after printing, in order to prevent ink from drying.

The ink sensor 19 detects the presence or absence of an ink cartridge 2 and ink in the ink cartridge 2. Hereinafter, the presence of ink means that the ink level is higher than a predetermined level in a sub-ink tank 45, and the absence of ink means that the ink level is lower than the predetermined level in the sub-ink tank 45. The ink sensor 19 is disposed near the end of the drive unit 6 (left side in FIG. 1), and includes an infrared light-emitting device 19*a* (see FIG. 5) and an infrared light receptor 19*b* (see FIG. 5). The ink sensor 19 is disposed so that a light-emitting surface of the infrared light-emitting device 19*a* and a light receiving surface of the infrared light receptor 19*b* are inclined the same amount as the inclination of an inclined portion 51*a* (see FIG. 4) of the ink cartridge 2. Further, the ink sensor 19 is disposed with its light-emitting surface turned approximately 10 degrees, with respect to the inclined portion 51*a* of the ink cartridge 2, in a horizontal direction (see an ink sensor 19 of FIG. 5C). The inclined portion 51*a* of the ink cartridge 2 is inclined approximately 20 degrees with respect to the vertical direction. Light irradiated from the infrared light-emitting device 19*a* is reflected from the ink cartridge 2, and the reflected light is received by the infrared light receptor 19*b*. In accordance with an amount of the received reflected light, the presence or absence of the ink cartridge 2 and that of the ink in the ink cartridge 2 are detected. The details of these detection will be described later.

Figure 2:
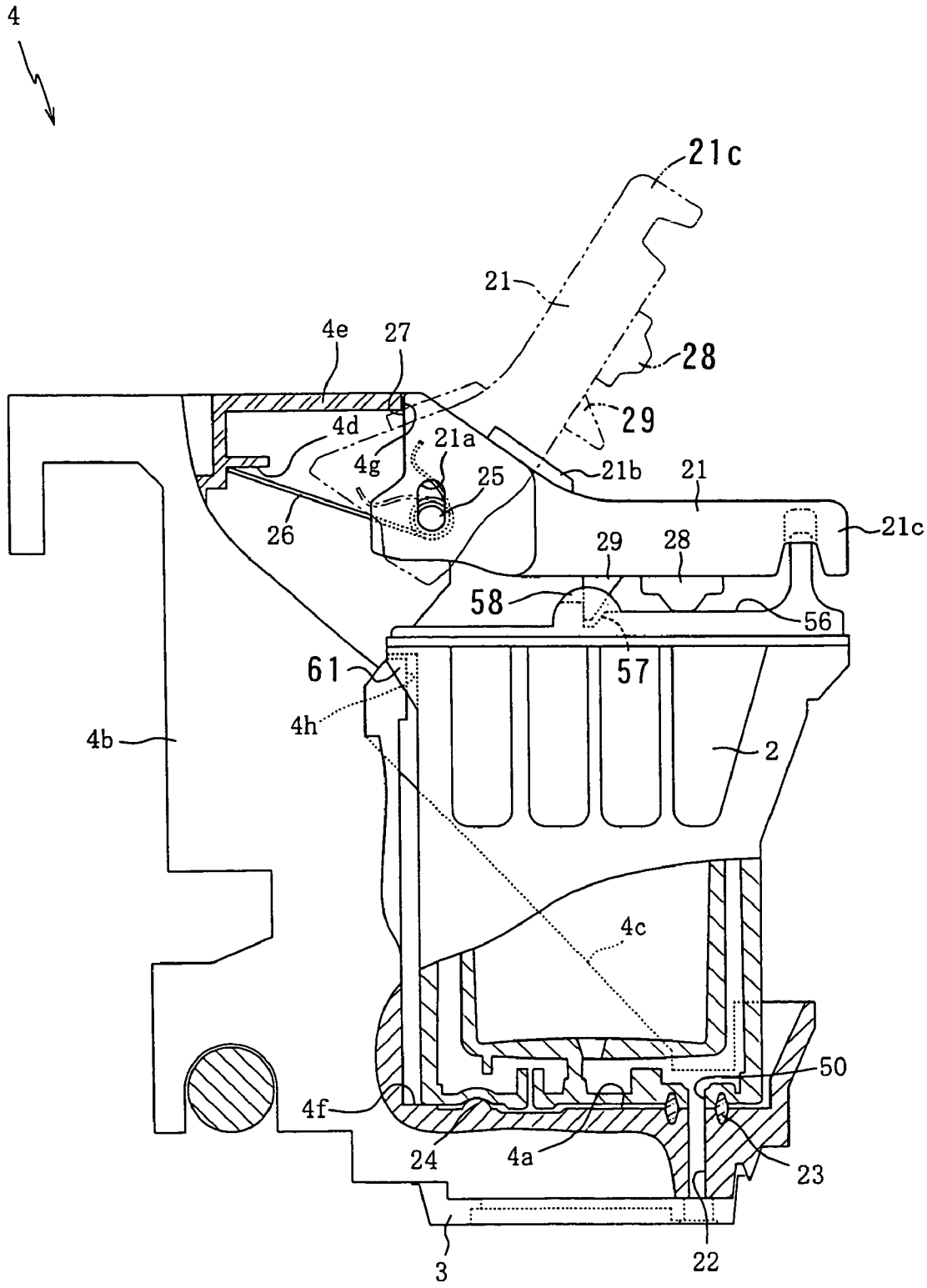
FIG. 2 is a side view showing a state where the ink cartridge is attached to a head unit.

As shown in FIG. 2, the head unit 4 is detachably attached with the ink cartridges 2 to supply ink to the print head 3, as described above. The head unit 4 includes the mounting portion 4*a* and fixing arms 21. The mounting portion 4*a*, having a flat surface, is mounted with the ink cartridges 2 thereon. The mounting portion 4*a* has the pair of side covers 4*b* and is partitioned into four areas by the three partitions 4*c*. The ink cartridges 2 are mounted in the respective areas.

The mounting portion 4*a* has ink supply paths 22, which penetrate the mounting portion 4*a* and communicate with the print head 3. The ink supply paths 22 communicate with respective ink outlets 50. Each connected portion of the ink supply path 22 and the ink outlet 50 is sealed by an O-ring 23. The connection allows ink to flow from the ink cartridges 2 to the print head 3. Engaging protrusions 24 protrude from the mounting portion 4*a*. Each of the engaging protrusions 24 is disposed on the side of the ink supply path 22 (the left of the ink supply path 22 in FIG. 2) to position each ink cartridge 2.

A raised portion 4*f* for regulating up-and-down movements of the ink cartridge 2 is formed behind of each engaging protrusion 24 (the left of the engaging protrusion 24 in FIG. 2) in the head unit 4.

The fixing arms 21, which are swingably supported at the upper portion of the head unit 4 (the upper portion in FIG. 2), press downward and secure the respective; ink cartridges 2 on the mounting portion 4*a*, as shown in FIG. 2. Though one of the fixing arms 21 will be described hereinafter, the other three fixing arms 21 have the same structure and operate in a similar manner. The fixing arm 21 is pivotally supported by a swing shaft 25 at one end (the left end in FIG. 2). An auxiliary spring member 26 is wound around a periphery of the swing shaft 25. One end of the auxiliary spring member 26 is engaged with a spring engaging portion 4*d* of the head unit 4 and the other end is fixed to the fixing arm 21, while the auxiliary spring member 26 exerts its urging force on the fixing arm 21 at all times. Therefore, when a stopper portion 27 is not engaged with an end 4*g* of an upper cover 4*e* (described later), the fixing arm 21 is raised by the urging force from the auxiliary spring member 26 and is maintained in this state (the state indicated by the double-dot and dashed line in FIG. 2). Thus, an ink cartridge mounting portion in the head unit 4 is widely opened and operability of an user can be improved when attaching or detaching the ink cartridges 2.

The stopper portion 27, having a triangular shape when viewed from the side, is formed at the one end (the left end in FIG. 2) of the fixing arm 21. The stopper portion 27 is provided to assist the fixing arm 21 in pressing and maintaining the ink cartridge 2 in a fixed state. The fixing arm 21 has a slot 21*a* for guiding the swing shaft 25. The slot 21*a* is long enough to allow the stopper portion 27 to release from the upper cover 4*e*. As a raised portion 21*b* formed on the fixing arm 21 is pressed, the fixing arm 21 moves downward in FIG. 2 along the slot 21*a*. Thus, the engagement of the upper cover 4*e* and the stopper portion 27 is released. When the ink cartridge 2 is to be fixed, a free end 21*c* of the fixing arm 21 in the state indicated with the double-dot and dashed line in FIG. 2 is pressed downward. As a result, the fixing arm 21 rotates downward around the swing shaft 25. After a pressing portion 28 contacts an upper wall 56 of the ink cartridge 2, the fixing arm 21 rotates against the auxiliary spring member 26 about the contact of the pressing portion 28 and the upper wall 56. When the stopper portion 27 moves to the right of the end 4*g* of the upper cover 4*e* from underneath of the upper cover 4*e*, the fixing arm 21 moves upward in FIG. 2 with respect to the swing shaft 25 due to the slot 21*a* formed in the fixing arm 21 and the stopper portion 27 is engaged with the end 4*g* of the upper cover 4*e* because the fixing arm 21 rotates about the contact of the pressing portion 28 and the upper wall 56. Accordingly, a state where the ink cartridge 2 is being urged and fixed by the pressing portion 28 and an engaging pawl 29 can be maintained.

As described above, the pressing portion 28 is disposed on the underside of the fixing arm 21. The pressing portion 28 has a compression spring (not shown) in an elastically compressed state therein and presses the ink cartridge 2 downward in FIG. 2. The pressing portion 28, which can protrude and retract, is normally held in a protruding position by the compression spring. As described above, as the fixing arm 21 is rotated toward the ink cartridge 2, the pressing portion 28 contacts the upper wall 56 of the ink cartridge 2, so that the pressing portion 28 retracts upward in FIG. 2. Accordingly, the pressing portion 28 can exert the urging force on the ink cartridge 2 by the stopper portion 27 and the compression spring, thereby pressing the ink cartridge 2 downward in FIG. 2.

The engaging pawl 29 is fixedly attached to the underside of the fixing arm 21, next to the pressing portion 28 (the left of the pressing portion 28 in FIG. 2). The engaging pawl 29 positions the ink cartridge 2 in a predetermined position. As shown in FIG. 2, while the engaging pawl 29 contacts a wall defining a second engagement recess 57, the engaging pawl 29 is free from the bottom of the second engagement recess 57. A detailed description of the positioning of the ink cartridge 2 will be described later.

Figure 3A:
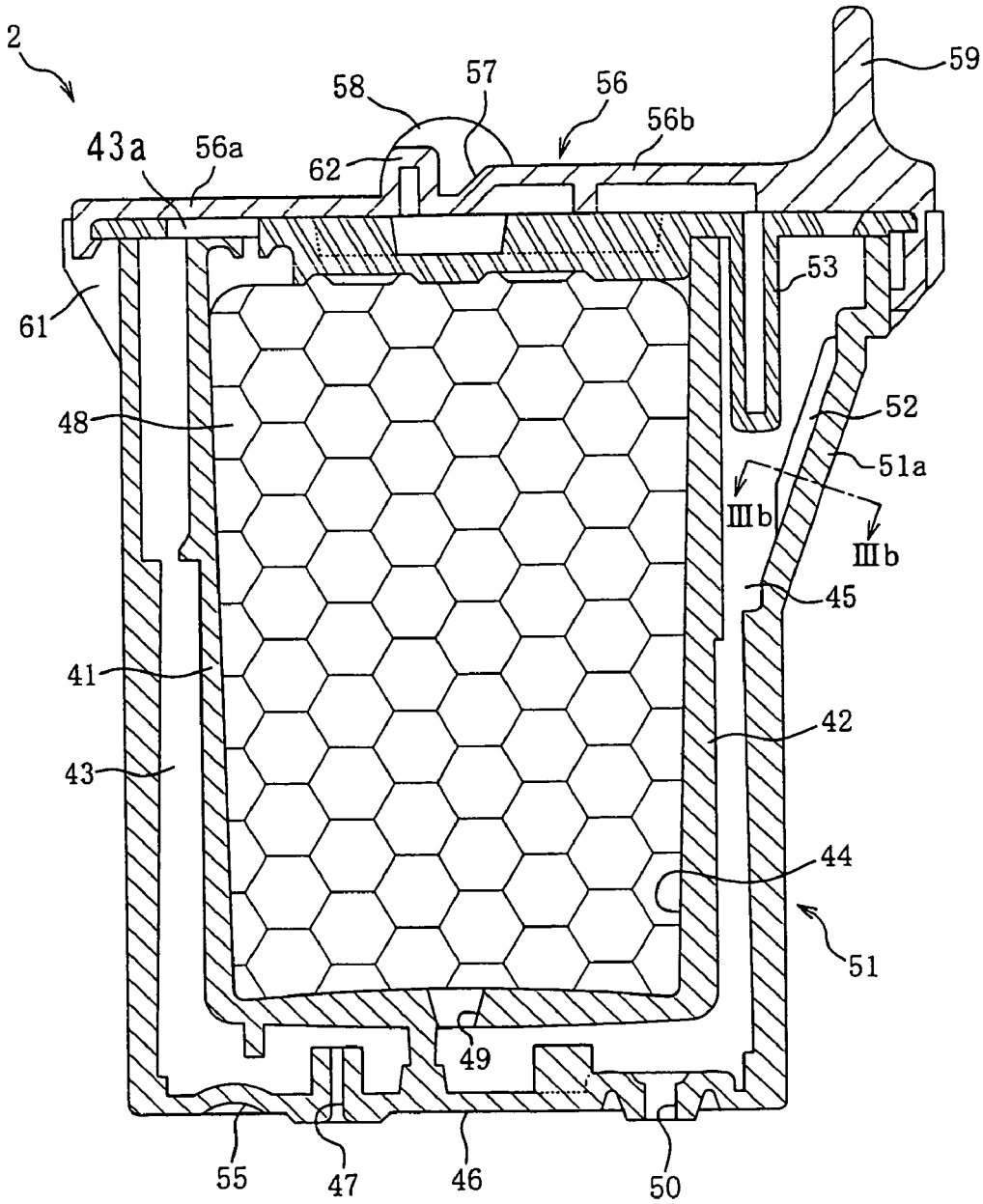
FIG. 3A is a side sectional view of the ink cartridge.

As shown in FIG. 3A, the ink cartridges 2 are formed in a generally hollow box shape. All of the ink cartridges 2 have the same structure. Partition walls 41, 42 are provided in the ink cartridge 2 to partition off the inside of the ink cartridge 2 into three areas, namely, an air trap chamber 43, a main ink tank 44, and the sub-ink tank 45. The air trap chamber 43 is a space for taking air into the main ink tank 44, and communicates with the outside (the air) via an air inlet 47 formed in a bottom wall 46 of the ink cartridge 2. A communication path 43*a* is provided above the air trap chamber 43 (FIG. 3A) and the main ink tank 44 so that they communicate with each other. Accordingly, the air can be taken into the main ink tank 44 from the air trap chamber 43, via the communication path 43*a*.

The main ink tank 44 is substantially enclosed to store ink therein, and accommodates a foam (porous member) 48 that can absorb the ink. An ink flow port 49 is formed in the partition wall 42 at the lower portion of the main ink tank 44. The main ink tank 44 communicates with the sub-ink tank 45 via the ink flow port 49. The foam 48 is made of, for example, a sponge or a fiber, that can retain ink therein using a capillary, and is accommodated in the main ink tank 44 in a compressed state. Therefore, for example, even when the ink cartridge 2 falls down or is dropped and thus ink therein leaks into the air trap chamber 43 from the main ink tank 44, the ink can be prevented from leaking out of the ink cartridge 2 from the air inlet 47.

The sub-ink tank 45 stores ink therein and is irradiated with infrared light from the ink sensor 19 (see FIG. 4). The sub-ink tank 45 provided in the side of the ink cartridge 2 is substantially enclosed. The sub-ink tank 45 communicates with the main ink tank 44 via the ink flow port 49. The ink stored in the main ink tank 44 and the sub-ink tank 45 is supplied to the print head 3 (see FIG. 2) via the ink outlet 50 formed in the bottom wall 46 of the ink cartridge 2.

A side wall 51 of the sub-ink tank 45 has the downwardly inclined portion 51*a* that inclines toward the main ink tank 44. An inner surface (the main ink tank 44 side, the left surface of the inclined portion 51*a* in FIG. 3A) of the inclined portion 51*a* has a plurality of prisms 52. As described above, the inclined portion 51*a* is inclined approximately 20 degrees with respect to the vertical direction.

The prisms 52 are used to detect the presence or absence of ink in the ink cartridge 2. The prisms 52 are integrally formed with the inner surface (the surface that contacts the ink) of the inclined portion 51*a* of the side wall 51 made of transparent or translucent light-permeable material. For the light-permeable material, acrylic resin, polypropylene, polycarbonate, polystyrene, polyethylene, polyamide, methacryl, methylpentene polymer or glass, can be used, for example.

Figure 3B:
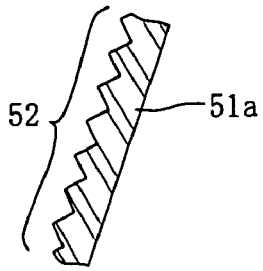
FIG. 3B is a partial sectional view taken along line IIIb—IIIb of FIG. 3A.

As shown in FIG. 3B, each of the prisms 52 has a plurality of reflecting surfaces, and the plurality of the prisms 52 form crests and troughs alternately. The reflecting surfaces inclinatorily and downwardly extend in a lengthwise direction of the inclined portion 51*a* from one end (an upper end in FIG. 3A) to the other end (a lower end in FIG. 3A), and are aligned in a thickness direction of the ink cartridge 2 (in a direction perpendicular to the plane of the drawing sheet of FIG. 3A). Thus, the ink can run over and fall off the prisms 52. With this structure, a desired amount of reflected light from the prisms 52 can be obtained without ink remaining on the prisms 52.

Figure 5:
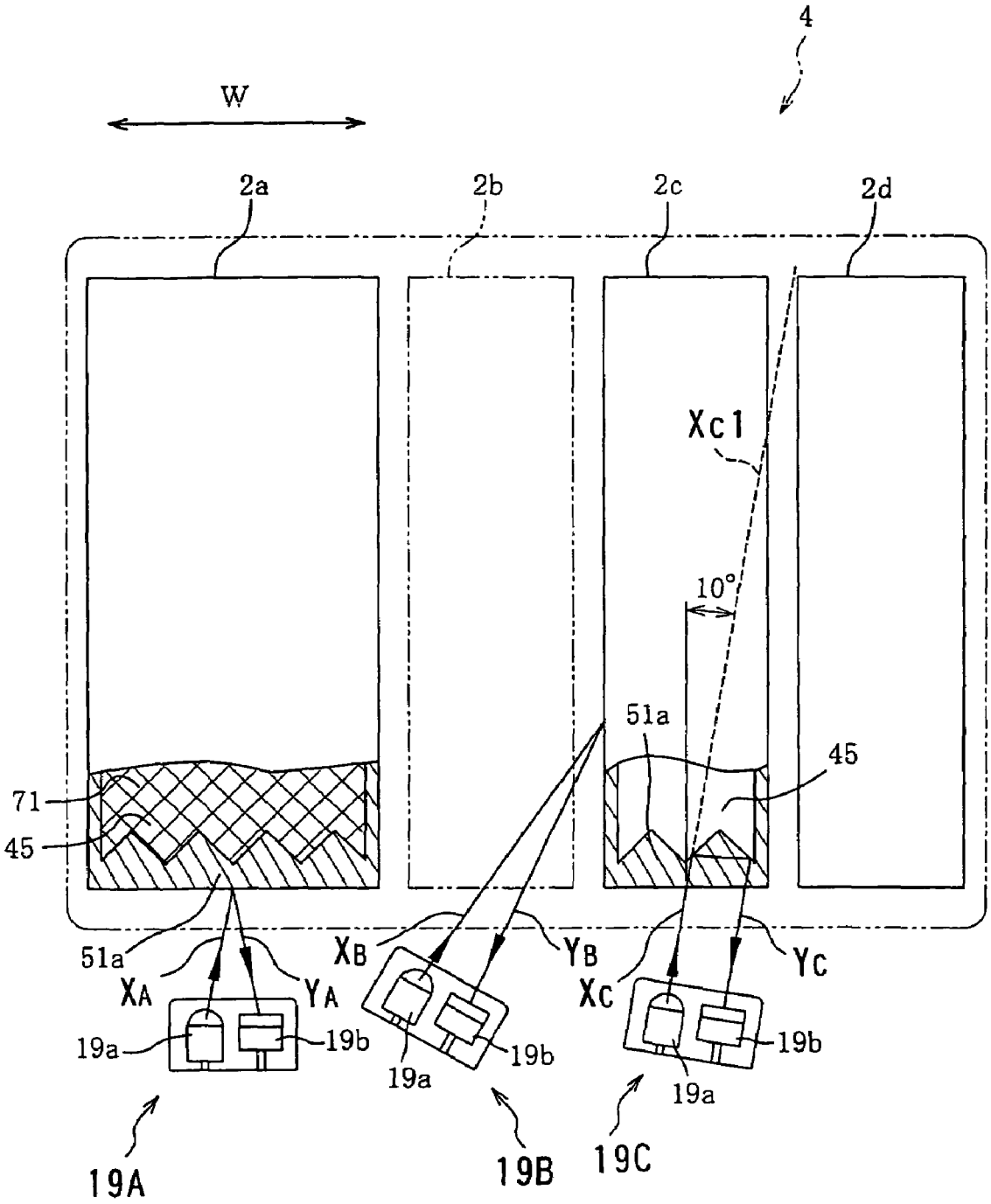
FIG. 5 is a top view of the ink cartridge and the ink sensor.

As described above, with the provision of the prisms 52 on the inner surface of the inclined portion 51*a*, infrared light can be irradiated in a slanting direction (in a direction approximately 10 degrees inclined with respect to the horizontal direction) from the ink sensor 19, from a direction opposed to the inclined portion 51*a* (see FIG. 5). As a result, infrared light, that is not related to the detection of the presence or absence of ink, can be prevented from being received by the infrared light receptor 19*b*. Thus, the infrared light receptor 19*b* can mainly receive reflected light necessary for the ink existence detection. This results in improving accuracy of the ink existence detection.

Infrared light to be irradiated from the infrared light-emitting device 19*a* in the ink sensor 19 toward the inclined portion 51*a*, generally has a predetermined beam angle (an angle of the neighborhood of ±10 degrees). Therefore, the luminous existence of the infrared light becomes large with the travel of the infrared light, so that the amount of light per unit area irradiated to the inclined portion 51*a* is decreased. In order to avoid this, the prisms 52 having the plurality of reflecting surfaces are provided to the entire inner surface of the inclined portion 51. Accordingly, the reflecting surfaces effectively reflect the irradiated infrared light and the infrared light receptor 19*b* in the ink sensor 19 can efficiently receive the reflected light. In the embodiment, as shown in FIG. 3B, the prisms 52 formed in the cyan, magenta and yellow ink cartridges 2*b*, 2*c*, 2*d* have sixteen reflecting surfaces, while the prisms 52 formed in the black ink cartridge 2*a* have twenty-four reflecting surfaces. An angle of each ridge, at which the reflecting surfaces intersect each other, is substantially 90 degrees in the prisms 52.

A reflector 53 is provided at the upper portion of the sub-ink tank 45, facing the prisms 52 while a predetermined space is left therebetween. The reflector 53 changes a traveling path of infrared light that passes through the sub-ink tank 45, via the inclined portion 51*a* and the prisms 52. The reflector 53 is disposed at an angle with respect to the prisms 52, and is pouched so as to provide air space 72 therein. In fact, the reflector 53 vertically extends into the ink cartridge 2. Thus, the reflector 53 is inclined with respect to the prisms 52.

According to the ink cartridge 2 structured as described above, when the ink is used by the print head 3, air is taken into the main ink tank 44 from the air trap chamber 43, in accordance with the amount of the ink consumed. As a result, the ink level in the main ink tank 44 is lowered (see FIG. 4A). When the ink in the main ink tank 44 runs out, the ink in the sub-ink tank 45 is supplied to the print head 3. At that time, pressure in the sub-ink tank 45 is reduced. However, the air is taken into the sub-ink tank 45 from the air trap chamber 43 via the main ink tank 44 and the ink flow port 49, so that the reduced pressure is moderated and the ink level is lowered (see FIG. 4B).

Thus, in the ink cartridge 2, first, the ink stored in the main ink tank 44 is consumed and then the ink stored in the sub-ink tank 45 is consumed. Accordingly, a remaining amount of ink in the cartridge 2 can be detected only by detecting the presence or absence of the ink in the sub-ink tank 45 using the ink sensor 19.

Figure 3C:
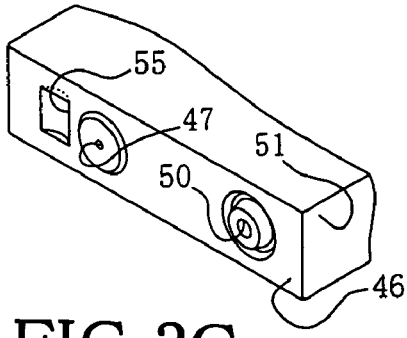
FIG. 3C is a perspective view of the bottom of the ink cartridge.

The bottom wall 46 of the ink cartridge 2 has a first engagement recess 55 in an end (a left end in FIG. 3A) opposed to the ink outlet 50. The first engagement recess 55 engages the engaging protrusion 24 protruding from the mounting portion 4*a* of the head unit 4 (see FIG. 2), to locate the ink cartridge 2 in position. As shown in FIG. 3C, the first engagement recess 55 is provided at a location that is substantially in the middle of the ink cartridge 2 in the thickness direction (in a direction perpendicular to the plane of the drawing paper of FIG. 3A). An annular groove is provided in both the periphery of the ink outlet 50 of the ink cartridge 2 and the ink supply path 22 of the head unit 4, which are connected to each other via the O-ring 23 disposed in their annular grooves (see FIG. 2). However, the ink cartridge 2 cannot be properly positioned by the O-ring 23 being the only connection because the ink cartridge 2 will turn about the ink outlet 50 (O-ring 23) due to inertia when the carriage 5 moves. Therefore, as described above, the first engagement recess 55, which can engage the engaging protrusion 24 of the head unit 4, is provided in the bottom wall 46 of the ink cartridge 2 (see FIG. 3C). This prevents the ink cartridge 2 from turning and locates the ink cartridge 2 in proper position. As a result, the ink cartridge 2 can be properly fixed to the head unit 4.

The upper wall 56 of the ink cartridge 2 has the second engagement recess 57, which engages the engaging pawl 29 provided on the fixing arm 21 of the head unit 4 (see FIG. 2) when the ink cartridge 2 is fixed to the head unit 4. The second engagement recess 57 prevents the ink cartridge 2 from moving upward and in the width direction of the ink cartridge 2 (in the right and left directions in FIG. 3A). The second engagement recess 57 is provided in a location that is substantially in the middle of the upper wall 56 in the width direction of the ink cartridge 2 (in the right and left directions in FIG. 3A), that is, in a location that is substantially between the ink outlet 50 and the first engagement recess 55, in the width direction of the ink cartridge 2. Thus, the ink cartridge 2 is supported and balanced at three points, the second engagement recess 57, the ink outlet 50 and the first engagement recess 55. That is, the second engagement recess 57, the ink outlet 50, and the first engagement recess 57 form a substantially isosceles triangle and the three points are considered the vertexes. With this structure, the ink cartridge 2 is prevented from lifting and rattling. Accordingly, the ink cartridge 2 can be stably and tightly fixed to the head unit 4.

A pair of side walls 58 are provided on the both sides of the second engagement recess 57 (near and far sides into the drawing paper of FIG. 3A). The side walls 58 are opposed to each other while a predetermined space is left therebetween. The side wall 58 provided on the far side is shown in FIG. 3A, and the side wall 58 provided on the near side is shown in FIG. 2. The side walls 58 prevent the ink cartridge 2 from moving in the thickness direction of the ink cartridge 2 (in the direction perpendicular to the plane of the drawing paper of FIG. 3A). The surfaces of the side walls 58 face each other in the thickness direction of the ink cartridge 2. A distance between the opposed surfaces of the side walls 58 is substantially equal to the width of the engaging pawl 29 (see FIG. 2) of the fixing arm 21 to be engaged with the second engagement recess 57. Accordingly, as the engaging pawl 29 of the fixing arm 21 engages the second engagement recess 57, the engaging pawl 29 is engaged with the side walls 58, so that the side walls 58 prevent the ink cartridge 2 from moving in the width direction of the ink cartridge 2 (the right and left directions in FIG. 3A).

As described above, the head unit 4 performs printing (see FIG. 1) by reciprocating in the thickness direction of the ink cartridge 2 (in the direction perpendicular to the plane of the drawing paper of FIG. 3A). During the printing, the head unit 4 hardly increases and reduces it speed to improve a printing speed. Therefore, if the ink cartridge 2 is displaced in the moving direction of the head unit 4 due to the hard movement of the head unit 4, then vibrations will occur in the head unit 4 traceable to the displacement, thereby degrading the quality of printing. However, the side walls 58, the first engagement recess 57 and the ink outlet 50 prevent the ink cartridge 2 from being displaced in the moving direction of the head unit 4, so that the head unit 4 can smoothly reciprocate without vibrations. As a result, excellent printing quality can be obtained.

The ink cartridge 2 has a pair of ribs 61 at its side (the left side in FIGS. 2 and 3A). One of the ribs 61 is shown in FIG. 3A and the other is shown in FIG. 2. The ribs 61 are opposed to each other while a predetermined distance is left therebetween, like the side walls 58. The head unit 4 has an engagement protrusion 4*h* (see FIG. 2) that protrudes from a position corresponding to the ribs 61. When the ink cartridge 2 is mounted on the head unit 4, the engagement protrusion 4*h* is inserted between the ribs 61, (see FIG. 2). Accordingly, the ribs 61 prevents the ink cartridge 2 from being displaced sideways while printing is performed.

The upper wall 56 includes a first upper wall 56*a* and a second upper wall 56*b*. The first upper wall 56*a* extends from one side of the second engagement recess 57 (the left side in FIG. 3A). The second upper wall 56*b* extends from another side of the second engagement recess 57 (the right side in FIG. 3A). The first upper wall 56*a* is provided at a level lower than the second upper wall 56*b*, from the bottom wall 46. A handle 59 is provided to an end opposed to the side of the first upper wall 56*a*. The handle 59 protrudes upward from the second upper wall 56*b* so that the user can easily pinch the handle 59 when attaching or removing the ink cartridge 2 to or from the head unit 4. Therefore, when the user desires to remove one of the ink cartridges 2 from the head unit 4, such as for replacing the ink cartridge 2, the user can pinch the handle 59 to pull out the ink cartridge 2 from the head unit 4. Thus, the ink cartridge 2 can be removed without interference by the other ink cartridges 2. When the user desires to mount the ink cartridge 2 on the head unit 4, the user can also easily attach the ink cartridge 2 to the head unit 4 by pinching the handle 59.

When the ink cartridge 2 is attached to the head unit 4, the ink cartridge 2 is inserted into a predetermined position on the head unit 4 from the side of the first upper wall 56*a*. As described above, the first upper wall 56*a* is provided at the level lower than the second upper wall 56*a* from the bottom wall 46, so that the first upper wall 56*a* does not interfere with the raising of the fixing arm 21. Accordingly, the ink cartridge 2 can be easily attached to the head unit 4 without being caught by the head unit 4 (see FIG. 2).

The upper wall 56 should not be made thinner than the rest of the ink cartridge 2 in order to maintain rigidity to bear the pressure from the pressing portion 28 of the fixing arm 21.

A first protrusion 62 protrudes upward from one side of the first upper wall 56*a* (the right side in FIG. 3). One of the walls forming the second engagement recess 57 is a part of the first protrusion 62. Therefore, when the engaging pawl 29 of the fixing arm 21 engages the second engagement recess 57, the first protrusion 62 prevents the ink cartridge 2 from moving upward and being displaced in the width direction of the ink cartridge 2 (in the right direction in FIG. 3A).

Figure 4A:
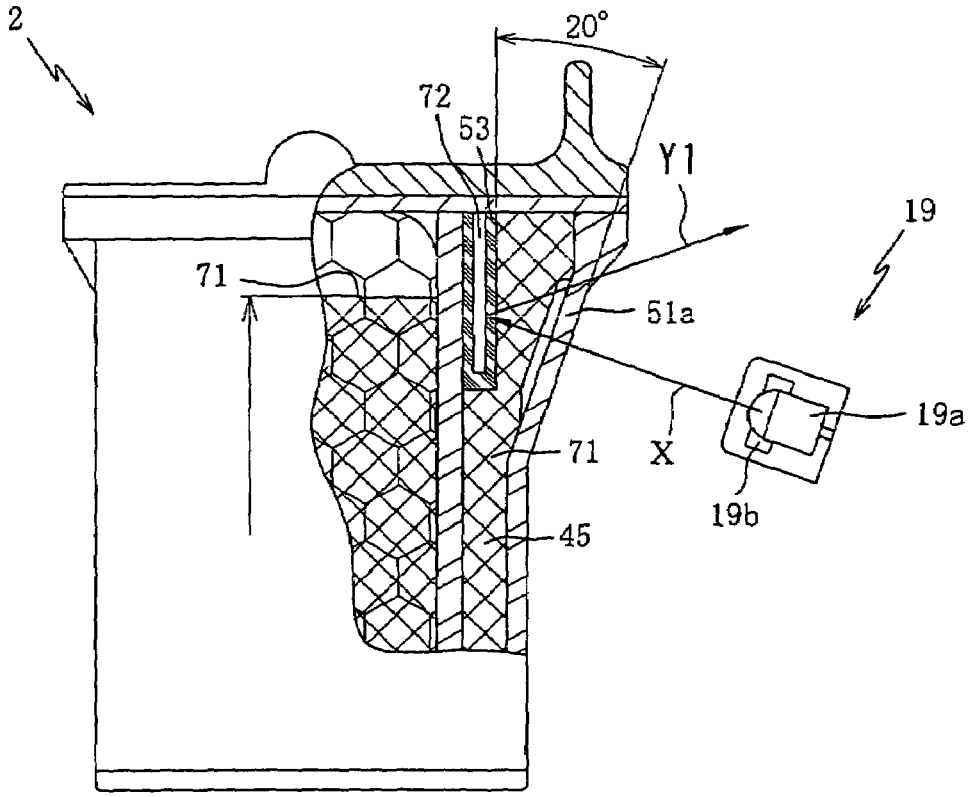
FIGS. 4A and 4B are side views of the ink cartridge and an ink sensor.
Figure 4B:
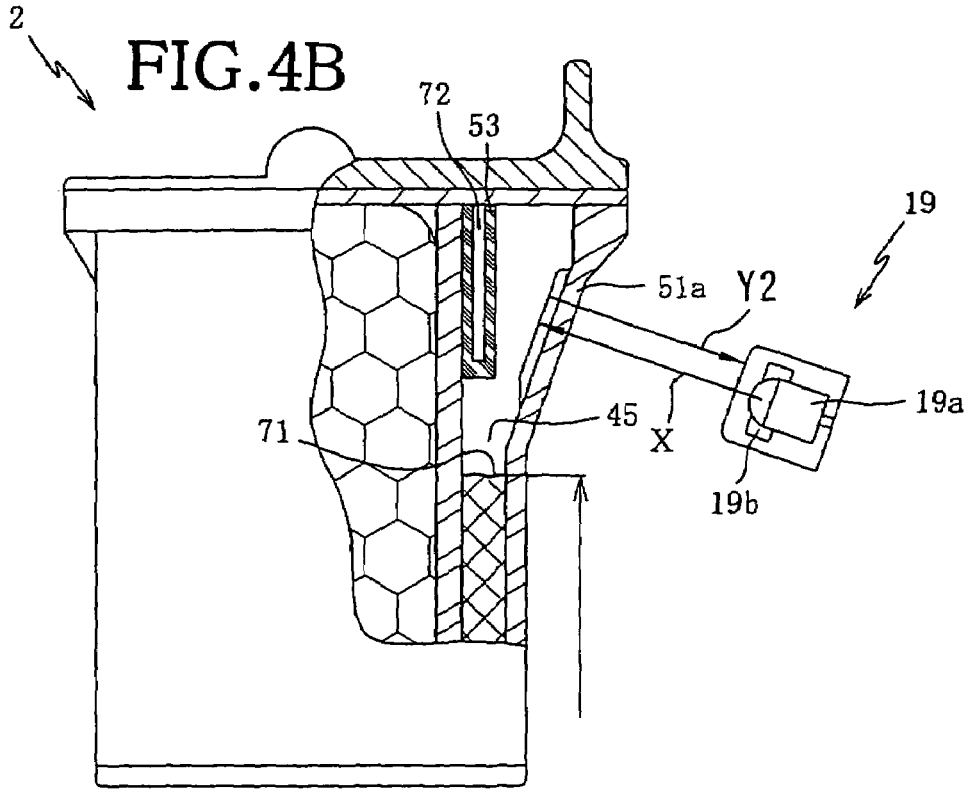

A principle of the detection of ink level will be described with reference to FIGS. 4A and 4B. In FIGS. 4A and 4B, the head unit 4 and a mounting member for the ink sensor 19 are omitted from the drawings.

As shown in FIG. 4A, when the ink cartridge 2 contains enough ink 71 for printing (when at least the sub-ink tank 45 is full of the ink 71), infrared light (optical path X) irradiated from the infrared light-emitting device 19*a* in the ink sensor 19 passes through the ink 71 and travels in the sub-ink tank 45 of the ink cartridge 2. This occurs because a refractive index of the material forming the ink cartridge 2 is close to a refractive index of the ink 71. Then, the infrared light reaches the reflector 53 disposed in the sub-ink tank 45. The infrared light reaching the reflector 53 is reflected at a phase boundary between an internal surface of the reflector 53 and air space 72 (optical path Y1) due to the difference of the refractive index between the material forming the reflector 53 and the air space 72.

The inclined portion 51*a* of the ink cartridge 2 is inclined approximately 20 degrees with respect to the reflector 53, in other words, with respect to the vertical direction, so that an incident angle of the infrared light with respect to the reflector 53 is different from that of the infrared light, irradiated from the infrared light-emitting device 19*a*, with respect to the inclined portion 51*a*. Therefore, the infrared light irradiated into the reflector 53 is reflected at the reflector 53 at an angle (the optical path Y1) different from the incident angle with respect to the inclined portion 51*a*. Thus, most of the reflected infrared light does not travel toward the infrared light receptor 19*b*, so that an extremely small amount of the light is reflected back to the infrared light receptor 19*b*.

As shown in FIG. 4B, when the ink 71 in the main ink tank 44 runs out and the ink level in the sub-ink tank 45 of the ink cartridge 2 is not up to the lower portion of the reflector 53, the infrared light (optical path X) irradiated from the infrared light-emitting device 19*a* in the ink sensor 19 is reflected at a phase boundary between an internal surface of the outer wall of the sub-ink tank 45 and air located in the sub-ink tank 45 (optical path Y2). This occurs because the refractive index of the material forming the ink cartridge 2 is different from that of the air. As a result, a large amount of the light is reflected back to the infrared light receptor 19*b*.

The amount of the light (optical path Y2), which is to be reflected from the inside of the ink cartridge 2 and is to travel toward the infrared light receptor 19*b*, changes in accordance with the presence or absence of the ink 71. Thus, the presence or absence of the ink 71 in the ink cartridge 2 can be precisely detected by the amount of the reflected light detected using the infrared light receptor 19*b* in the ink sensor 19.

The inclined portion 51*a* and the reflector 53 are disposed at the upper portion of the sub-ink tank 45. Therefore, low ink can be detected at the point of the absence of the ink 71 at the upper portion of the sub-ink tank 45, that is, a near-empty state can be detected that indicates the ink 71 will run out in the near future, before the ink cartridge 2 becomes completely empty of the ink 71.

In this embodiment, the inclined portion 51*a* is inclined approximately 20 degrees with respect to the reflector 53. However, it is not limited to the angle described above. The inclined portion 51*a* is preferably inclined between approximately 15 degrees and 25 degrees with respect to the reflector 53. That is, when the inclined portion 51*a* is inclined approximately 15 degrees or greater with respect to the reflector 53, the amount of light to be reflected from the reflector 53 toward the infrared light receptor 19*b* can be restricted. Further, when the angle of the inclination is approximately 25 degrees or smaller, the ink 71 can be prevented from always collecting on the inclined portion 51*a*.

The reason that the ink sensor 19 is disposed with its light-emitting surface turned approximately 10 degrees in a horizontal direction with respect to the inclined portion 51*a* (FIG. 3) of the ink cartridge 2 is as described below. In FIG. 5, the ink cartridges 2*a* to 2*d* are mounted on the head unit 4 and are moved back and forth in directions indicated with an arrow W.

When the ink sensor 19 is disposed so that its light-emitting surface is perpendicular to the inclined portion 51*a* (see an ink sensor 19A in FIG. 5), light (optical path XA) irradiated from the infrared light-emitting device 19*a* passes through the inclined portion 51*a* made of the light-permeable material. However, the incident light (optical path XA) that is suppose to pass through the inclined portion 51*a* might be reflected at the outer surface of the inclined portion 51*a* due to microscopic asperities on the outer surface. Then, the reflected light (optical path YA) is received by the infrared light receptor 19*b*. As a result, the ink sensor 19 might determine that the ink is absent even though the ink is actually present in the sub-ink tank 45. Consequently, such placement has an adverse effect on the detection accuracy of the presence or absence of ink.

When the ink sensor 19 is disposed with its light-emitting surface turned greater than approximately 10 degrees in a horizontal direction, with respect to the inclined portion 51*a* (see an ink sensor 19B in FIG. 5), light (optical path XB) irradiated from the infrared light-emitting device 19*a* might be reflected by the adjacent ink cartridge 2*c*, if the ink cartridge 2*b* is absent. When the light reflected by the adjacent ink cartridge 2*c* (optical path YB) is received by the infrared light receptor 19*b*, the ink sensor 19 might determine that the ink cartridge 2*b* is present in the proper position even though the ink cartridge 2*b* is absent. As a result, there may be a case where the presence or absence of the ink cartridge 2*b* cannot be correctly detected.

When the ink sensor 19 is disposed with its light-emitting surface turned approximately 10 degrees in the horizontal direction with respect to the inclined portion 51*a* (see an ink sensor 19C in FIG. 5), the light XC is irradiated from the infrared light-emitting device 19*a* and reflected at the outer surface of the inclined portion 51*a*. However, the receipt of the reflected light (see the optical path YA in FIG. 5) by the infrared light receptor 19*b* can be restricted. Accordingly, as described in FIG. 4, when the ink is present, the light that passes through the inclined portion 51*a* is not received by the infrared light receptor 19*b*. On the other hand, when the ink is absent, the light is reflected at the phase boundary between the inner surface of the inclined portion 51*a* and the air, and the infrared light receptor 19*b* receives the reflected light (the optical path YC). Thus, the presence or absence of ink can be correctly detected according to the amount of the reflected light. Further, even when the ink cartridge 2*c* is absent, the adjacent ink cartridge 2*d* is not irradiated with light irradiated from the infrared light-emitting device 19*a* (see an optical path XC1). Consequently, the presence or absence of the ink cartridge 2 can be correctly detected.

In this embodiment, the ink sensor 19 is turned approximately 10 degrees with respect to the inclined portion 51*a*. However, the amount of turn of the ink sensor 19 is determined by factors, such as a size of the ink cartridges 2, a distance between each ink cartridge 2 and a distance between the ink cartridges 2 and the ink sensor 19. Accordingly, the amount of turn is not limited to that in this embodiment, as long as the ink sensor 19 is disposed with its light-emitting surface turned some degrees with respect to the inclined portion 51*a*, as compared to the case where infrared light is perpendicularly irradiated to the ink cartridge 2 from the front as shown by the ink sensor 19A in FIG. 5.

Figure 6:
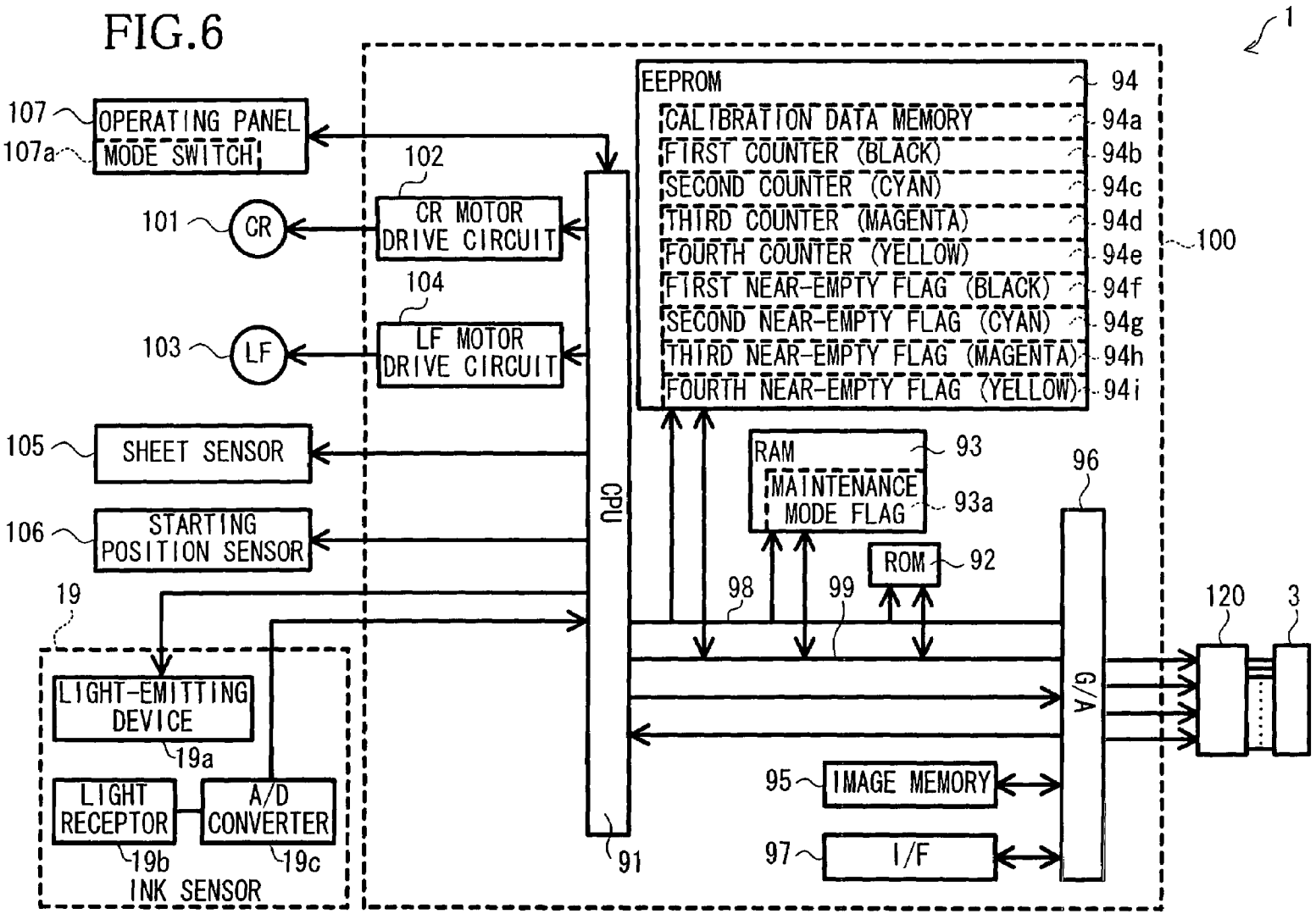
FIG. 6 is a schematic block diagram showing an electrical circuit of the color ink jet printer.

As shown in FIG. 6, a controller for the color ink jet printer 1 includes the printer control circuit board 100 and the carriage circuit board 120. The printer control circuit board 100 is mounted with a microcomputer (CPU) 91 composed of a single chip, a ROM 92 that stores various control programs to be executed by the CPU 91 and fixed value data, a RAM 93 that is a memory for temporarily storing various data, an EEPROM 94 that is a non-volatile rewritable memory, an image memory 95, and a gate array (G/A) 96.

The CPU 91 executes a control for detecting the presence or absence of ink and that of ink cartridges 2 in accordance with the control program prestored in the ROM 92. The CPU 91 generates a print timing signal and a reset signal to transmit the signals to the gate array 96. The CPU 91 is connected with an operating panel 107 that is used by the user to issue a command such as printing, a motor drive circuit 102 that drives the carriage motor (CR motor) 101 for moving the carriage 5, a motor drive circuit 104 that activates a feed motor (LF motor) 103 for feeding the recording medium P, a sheet sensor 105 that detects a leading edge of the recording medium (printing sheet) P, a starting position sensor 106 that detects a starting position of the carriage 5, the ink sensor 19, and the like. Each of the devices is controlled by the CPU 91.

Figure 10:
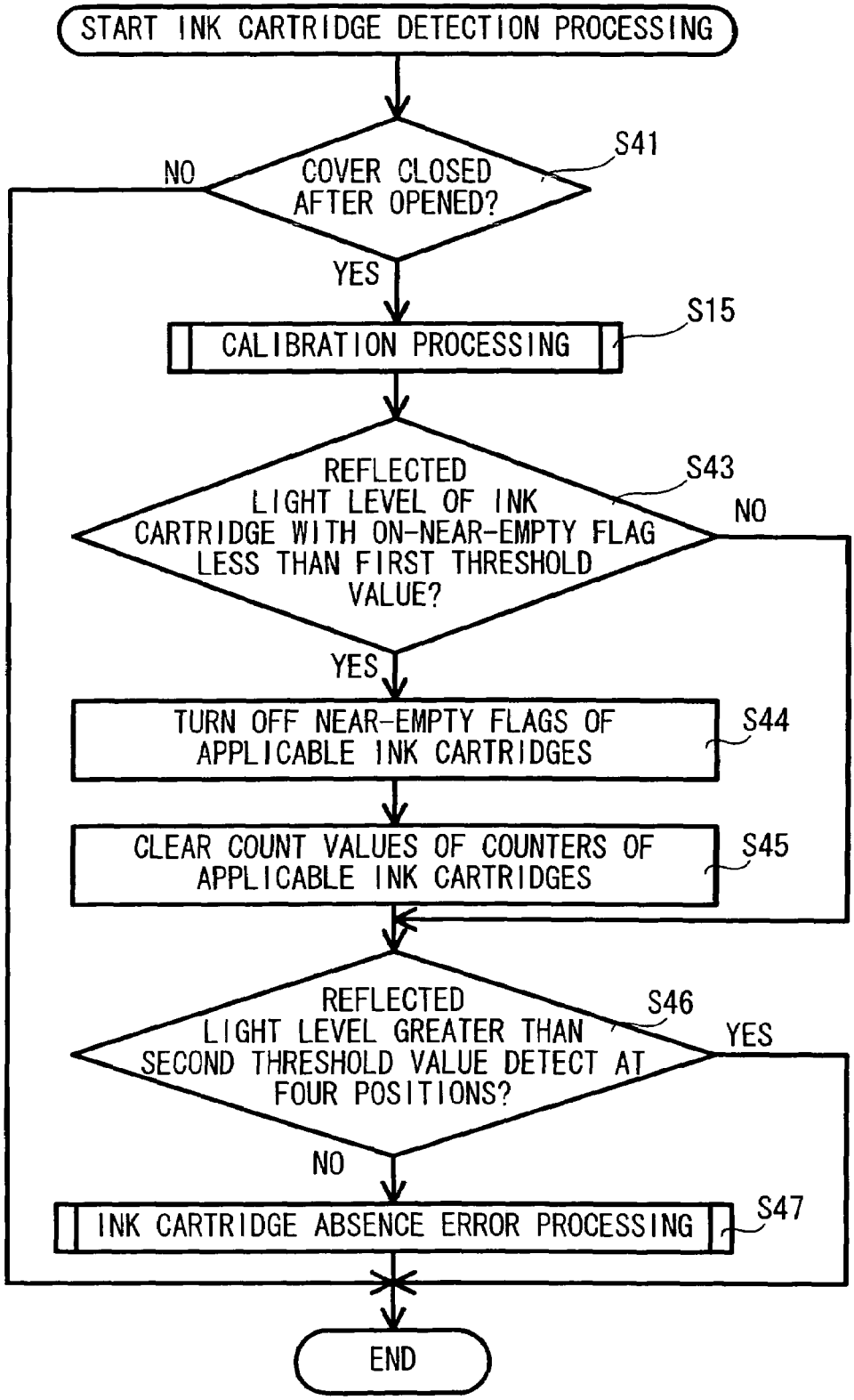
FIG. 10 is a flowchart of ink cartridge detection processing.

The ROM 92 stores a positional relationship (relative position) between the ink sensor 19 and the irradiated surface of the ink cartridge 2, as a part of the control program, that is, programs for calibration data input processing for inputting an amount of a deviation (correction value) from a theoretical value that is obtained by measuring a detection position of the ink cartridge 2 (see FIG. 7), ink detection processing for detecting the presence or absence of ink in the ink cartridge 2 (see FIG. 8), and ink cartridge detection processing for detecting the presence or absence of ink cartridges 2 on the head unit 4 (see FIG. 10). Each of the programs will be described later in detail. As the fixed value data, the ROM 92 stores a first threshold value for examining the absence of ink in accordance with a level of detected reflected light, a second threshold value for examining the absence of ink cartridges 2 by the level of the detected reflected light, and an empty threshold value that is the maximum number of times that ink can be ejected until the ink level (remaining amount of the ink) becomes an empty level from a near-empty level.

The RAM 93 includes a maintenance mode flag 93*a* that indicates that the color ink jet printer 1 is placed in a maintenance mode for maintaining the color ink jet printer 1. The maintenance mode is set by operation of a mode switch 107*a* provided to the operating panel 107. The selection of the maintenance mode turns the maintenance mode flag 93*a* on. The maintenance mode flag 93*a* is to be turned off upon input of a command indicating completion of the maintenance of the color ink jet printer 1. Only when the maintenance mode flag 93*a* is on, the calibration data input processing can be performed and the correction value can be stored.

The EEPROM 94 includes a calibration data memory 94*a*, first to fourth counters 94*b* to 94*e*, and first to fourth near-empty flags 94*f* to 94*i*. The calibration data memory 94*a* stores a correction value detected by the calibration data input processing, that is, an amount of a deviation from a proper detection position of the ink cartridge 2, as calibration data.

As described above, in the color ink jet printer 1 of the embodiment, the ink sensor 19 is disposed with its light-emitting surface turned approximately 10 degrees with respect to the irradiated surface (the inclined portion 51*a*) of the ink cartridge 2. However, there is a case, which often happens, where the ink sensor 19 may not be disposed with its light-emitting surface turned approximately 10 degrees with respect to the horizontal direction due to variations in the mounting angle of the ink sensor 19. In this case, the ink sensor 19 and the ink cartridge 2 are not relatively placed in a proper position. That is, the ink cartridge 2 is displaced from the proper detection position of the ink cartridge 2, so that the ink sensor 19 cannot precisely detect the ink cartridge 2 at the proper detection position. Therefore, an error between the proper detection position and an actual detection position is detected by the calibration data input processing performed prior to shipment, and the amount of the deviation is written in the calibration data memory 94*a* as the correction value (in advance and prior to shipment).

When the presence or absence of the ink cartridges 2 (examination of the absence of the ink cartridges 2) and that of the ink (examination of the absence of the ink) is detected, a detection position, in which the amount of reflected light is detected (a position of the carriage 5), is adjusted with reference to the correction value stored in the calibration data memory 94*a*. As a result, even when the ink sensor 19 and the irradiated surface of the ink cartridge 2 are not placed in the proper position due to variations in the mounting angle of the ink sensor 19, the presence or absence of the ink cartridge 2 and the ink can be correctly detected.

The first to fourth counters 94*b* to 94*e* count the number of times of ink ejection from the print head 3. Each of the counters 94*a* to 94*e* increases by one every time a single ink droplet is ejected from the corresponding ink cartridge 2. The ink cartridge 2 is filled with a predetermined amount of ink in advance, so that the maximum number of times of ink ejection can be predicted based on the amount of the ink. Thus, the counting of the number of times of ink ejection provides a rough estimation of the amount of the ink consumed.

The color ink jet printer 1 includes the first to fourth counters 94*b* to 94*e* for ink cartridges 2*a* to 2*d*, respectively. The counters 94*b* to 94*e* count and store the number of times of ink ejection from the corresponding ink cartridges 2*a* to 2*d*. The count values stored in the counters 94*b* to 94*e* are referred to at the ink detection processing. Every time the count values reach a predetermined number, the ink level detection is performed by the ink sensor 19 (the ink detection processing, see FIG. 8) to ascertain an actual ink level (a remaining amount of ink in the ink cartridge 2).

Not only when printing is performed, but also when purging for sucking air bubbles in the ink cartridge 2 and flushing for resolving clogs are performed, a predetermined amount of ink is ejected from the ink cartridges 2. It is known how many times of ink ejection in printing is equivalent to an amount of ink to be used in these processes. When the purging or flushing is performed, the respective counters 94*b* to 94*e* update their count values by adding count values, equivalent to the number of times of ink ejection of the purging or flushing, to their stored count values.

A single near-empty flag 94*f* to 94*i* is provided for each ink cartridge 2*a* to 2*d*, respectively. The near-empty flags 94*f* to 94*i* are turned on when the ink in the corresponding ink cartridges 2 become near-empty. The near-empty flags 94*f* to 94*i* indicate an ink detection limit by the ink sensor 19, that is, a state where the ink sensor 19 detects that the ink is absent.

As shown in FIGS. 3 and 4, the ink cartridge 2 is filled with ink. In the ink cartridge 2, first, the ink stored in the main ink tank 44 is consumed, and then, the ink in the sub-ink tank 45 is used after the main ink tank 44 nearly runs out. When the ink level of the sub-ink tank 45 becomes lower than the lower portion of the reflector 53, light irradiated from the infrared light-emitting device 19*a* in the ink sensor 19 is reflected by the prisms 52 toward the infrared light receptor 19*b* in the ink sensor 19 (optical path Y2). Therefore, the amount of reflected light to be detected by the infrared light receptor 19*b* in the ink sensor 19 is increased. The detected amount of reflected light is inputted into the CPU 91 as a signal, so that the amount of change in the reflected light is recognized by the CPU 91 that the ink cartridge 2 is near-empty. As a result, the near-empty flag 94*f* to 94*i* corresponding to the near-empty ink cartridge 2 is turned on.

At the time when the first to fourth near-empty flags 94*f* to 94*i* are turn on (the ink sensor 19 detects that the ink is absent), the ink is not completely empty in the corresponding ink cartridges 2*a* to 2*d* (the ink cartridges 2*a* to 2*d* are not empty). Printing can be performed until the ink cartridges 2*a* to 2*d* become actually empty (until the number of times of ink ejection reaches an empty threshold value).

In the embodiment, in order to precisely detect that the ink cartridge 2 is empty of ink, when any of the first to fourth near-empty flags 94*f* to 94*i* is turned on, the count value stored in the first to fourth counters 94*b* to 94*e*, corresponding to the ink cartridge 2 whose near-empty flag 94*f* to 94*i* is on, is cleared to 0. Then, the counter 94*f* to 94*i* counts up to the empty threshold value from 0, thereby improving detection accuracy that the ink cartridge is empty of ink. In this case, when any one of the counters 94*b* to 94*e* counts to the empty threshold value, the controller immediately suspends the printing performed by the print head 3 or stops the printing performed by the print head 3 when the printing is completed to a predetermined breakpoint. At the same time, the controller indicates to the user that the empty ink cartridge 2 needs to be replaced, through a display (not shown) or a speaker (not shown) of the operating panel 107, for example. The near-empty flag 94*f* to 94*i*, which have been turned on, is to be turned off when the CPU 91 detects that the ink is present, such as after replacement of the ink cartridge 2 (see FIG. 10).

The CPU 91 is connected with the ROM 92, the RAM 93, the EEPROM 94 and the gate array 96 which are all connected to each other, via an address bus 98 and a data bus 99.

In accordance with a print timing signal transmitted from the CPU 91, the gate array 96 outputs print data (drive signal), a transfer clock CLK that synchronizes with the print data, a latch signal a parameter signal for generating a basic waveform signal, and an ejection timing signal JET, and transfers these signals to the carriage circuit board 120 mounted with the head driver. The print data (drive signal) is for printing an image on a recording medium based on image data stored in the image memory 95. The ejection timing signal is to be outputted at predetermined intervals. The gate array 96 stores image data transferred from external equipment, such as a computer, via a Centronics interface (I/F) 97, in an image memory 95. The gate array 96 generates a Centronics data receipt interruption signal based on Centronics data transferred from a host computer via the Centronics interface 97 and transfers the signal to the CPU 91. Signal communications between the gate array 96 and the carriage circuit board 120 is performed via a harness cable.

As described above, the ink sensor 19 includes the infrared light-emitting device 19*a* and the infrared light receptor 19*b*. The ink sensor 19 irradiates infrared light (optical path X in FIG. 4B) from the infrared light-emitting device 19*a* and detects an amount of reflected light (optical path Y2 in FIG. 4B) using the infrared light receptor 19*b*. The received reflected light is photoelectrically converted by the infrared light receptor 19*b* and detected as an electric analog signal associated with the amount of the received reflected light. Then, the detected signal is converted into a digital signal by an A/D converter 19*c* connected to the infrared light receptor 19*b*. After that, the converted signal is inputted into the CPU 91. The amount of the reflected light detected by the ink sensor 19 is compared with the first and second threshold values at the ink detection processing and the ink cartridge detection processing. By doing so, the presence or absence of the ink and that of the ink cartridges 2 can be detected. The A/D converter 19*c* converts an analog signal into a digital signal in several steps, such as sampling, quantization and binary conversion.

The carriage circuit board 120 drives the print head 3 by the head driver (drive circuit) mounted on the carriage circuit board 120. The print head 3 is connected with the head driver by a flexible wiring board on which a wiring pattern is formed on a polyimide film of 50 to 15 μm in thickness using a copper foil. The head driver is controlled via the gate array 96 mounted on the printer control circuit board 100 and applies a drive pulse having a waveform corresponding to a recording mode to each drive device. As a result, a predetermined amount of ink is ejected.

Figure 7:
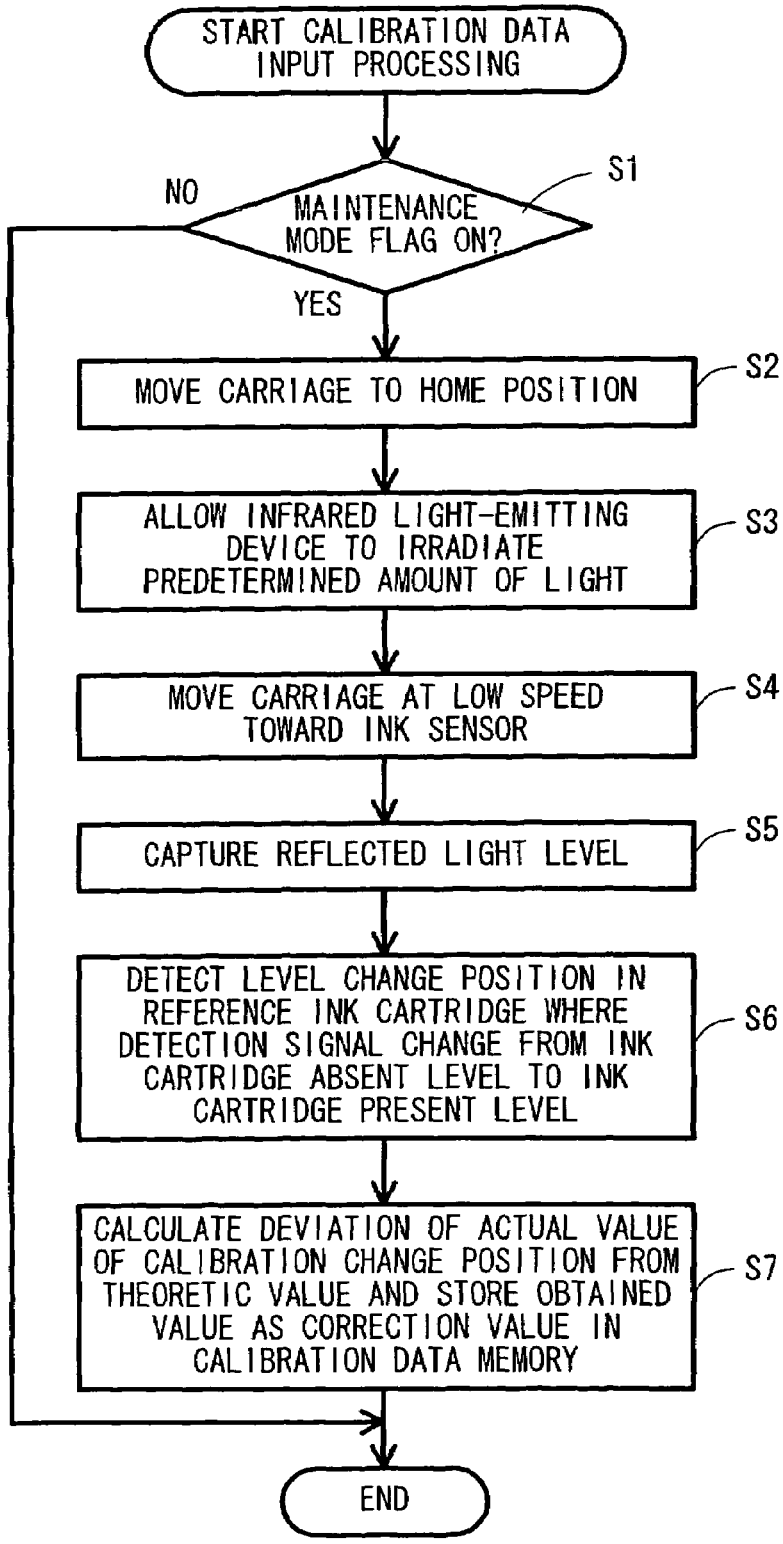
FIG. 7 is a flowchart of calibration data input processing of one of control programs.

As shown in FIG. 7, the calibration data input processing is executed prior to shipment, wherein a deviation of a detection position of an ink cartridge 2 from a proper detection position is detected and an amount of the deviation is stored in the calibration data memory 94*a* as a correction value.

As described above, the calibration data input processing can be executed only when the color ink jet printer 1 is placed in the maintenance mode. At the calibration data input processing, first, the CPU 91 determines whether the maintenance mode flag 93*a* is on (S1) (Hereinafter, S stands for a step.). When the maintenance mode flag 93*a* is not on (S1: No), the calibration data input processing is finished. When the maintenance mode flag 93*a* is on (S1: Yes), the CPU 91 makes sure that the carriage 5 is located in a starting position using the starting position sensor 106 and then moves the carriage 5 to a home position by a predetermined distance from a starting position by driving the CR motor 101 (S2). The starting position is a position for controlling the position of the carriage 5. By detecting that the carriage 5 is located in the starting position by the starting position sensor 106, the control of a position of the carriage 5 after moved, the ink ejecting position and the timing of ink ejection is performed without a hitch. The home position is a position that is apart from the starting position by a predetermined distance, and a predetermined position where calibration processing is executed. Next, the CPU 91 allows the infrared light-emitting device 19*a* to irradiate a predetermined amount of light (S3) and moves the carriage 5 at a low speed toward the ink sensor 19 (S4). As the carriage 5 reaches a predetermined detection position (as the carriage 5 moves a predetermined distance from the starting position), the amount of the reflected light is detected (S5). At S5, more particularly, the CPU 91 allows the infrared light receptor 19*b* to receive the light reflected from the ink cartridge 2, and then the CPU 91 captures the reflected light level (the amount of the reflected light) via the A/D converter. The reflected light level is detected not only at the proper detection position of the ink cartridge 2, but also in an area wider than the width of the ink cartridge 2. The reflected light level is detected in analog data (see FIGS. 11A and 11B).

Then, with respect to the captured reflected light level, the CPU 91 detects a level change position where a detection signal indicating a reference ink cartridge 2 is changed to an ink cartridge present level from an ink cartridge absent level (S6). When the ink cartridge 2 is absent (is not attached to the head unit 4), the amount of the reflected infrared light is small. Accordingly, the reflected light level is within the ink cartridge absent level. On the other hand, when the ink cartridge 2 is present (is attached to the head unit 4), the amount of the reflected infrared light is large. Accordingly, the reflected light level is within the ink cartridge present level. That is, the detection position of the ink cartridge 2 is the position where the reflected light level changes from the ink cartridge absent level to the ink cartridge present level (see FIGS. 11A and 11B).

An amount of a deviation of the level change position detected at S6 from a proper level change position (theoretical value) supposed to be detected, is obtained. The obtained value (the amount of deviation of an actual detection position from a proper detection position) is referred to as a carriage moving distance $\alpha$. The CPU 91 stores the deviation amount into the calibration data memory 94*a*, as a correction value (S7). The proper detection position (theoretical value) is stored as a moving amount of the carriage 5 from the starting position. Thus, the actual detection position is equal to the theoretical value $\pm\alpha$ (the carriage moving amount). The distance of $\pm\alpha$ comes to be the correction value, and is stored in the calibration data memory 94*a*.

The correction value stored in the calibration data memory 94*a* at the calibration data input processing is used at calibration processing (S15) to be executed during the ink detection processing and the ink cartridge detection processing. The detection position where the reflected light from the ink cartridge 2 is detected is corrected and the reflected light level can be precisely detected.

In this embodiment, the actual detection position and the theoretical detection position are compared with each other, with respect to the reference ink cartridge 2 at S6. The reference ink cartridge 2 is an ink cartridge 2 that is at the head of the ink cartridges 2 mounted on the carriage 5, in other words, a black ink cartridge 2*a* that is to be detected first (reaches the detection position first).

Figure 8:
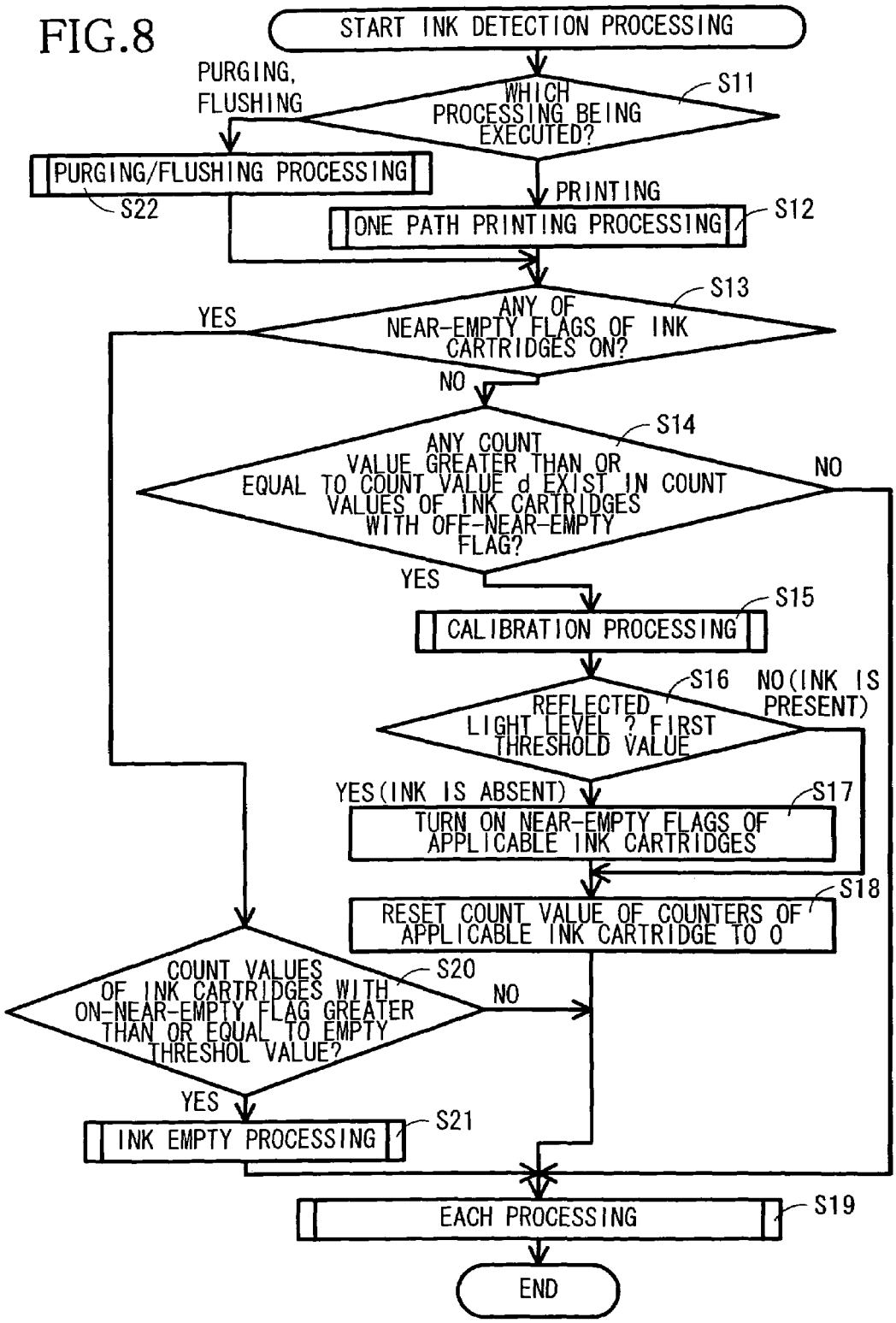
FIG. 8 is a flowchart of ink detection processing for performing ink detection.

As shown in FIG. 8, the ink detection processing is repeatedly executed at predetermined intervals to detect an amount of ink consumed when the print head operates. That is, the ink detection processing is performed when any of the first to fourth counters 94*b* to 94*e* count the predetermined number of times of ink ejection. The ink detection processing is preferably performed also in other cases, for example, immediately before printing is started or when attachment of the ink cartridge 2 is detected.

At the ink detection processing, first, the CPU 91 determines which processing is being executed in the color ink jet printer 1 (S11). When printing is being executed (S11: printing), the CPU 91 executes one path printing processing to perform a path of printing (S12). At the one path printing processing (S12), in order to calculate the amount of ink consumed, the CPU 91 counts the number of times of ink ejection of each ink cartridge 2 and increments the count values stored the corresponding counters 94*b* to 94*e*.

Next, the CPU 91 determines whether any of the first to fourth near-empty flags 94*f* to 94*i* of the ink cartridges 2 is on (S13). When any of the first to fourth near-empty flags 94*f* to 94*i* is off (S13: No), the CPU 91 determines whether there is a count value that is greater than or equal to a predetermined value d (e.g. 100) in the count values of the ink cartridges 2 whose near-empty flag is off (S14). The ink detection processing is performed every time the number of times of ink ejection reaches the predetermined value d to detect the presence or absence of ink.

When the count value is greater than or equal to the predetermined value d (e.g. 100) (S14: Yes), the CPU 91 executes the calibration processing, in which the correction of the detection position and the reading of the reflected light level (the amount of the reflected light) are performed, to detect the presence or absence of ink by the ink sensor 19 (S15). After the calibration processing (S15), it is determined whether the captured reflected light level is greater than or equal to the first threshold value (S16). The first threshold value is a reference value to determine whether the reflected light level is within the ink present level or absent level.

When the amount of the captured reflected light is greater than or equal to the first threshold value (S16: Yes), the ink level of the sub-ink tank 45 is lower than the lower end of the reflector 53. This means that the ink level (the remaining amount of the ink in the ink cartridge 2) is near-empty (it is detected that the ink is absent). Therefore, the near-empty flag 94*f* to 94*i* corresponding to the near-empty ink cartridge 2 is turned on (S17), and the count value of the near-empty ink cartridge 2 (the count value stored in the corresponding counter 94*b* to 94*e*) is cleared to 0 (S18). Then, the CPU 91 performs other processing (S19) and completes the ink detection processing.

As a result of S11, when the processing being executed is purging or flushing (S11: purging, flushing), the CPU 91 performs the purging or flushing processing (S22). In the purging processing, ink is ejected to purge air bubbles in the ink cartridge 2. In the flushing processing, ink is ejected to resolve clogging in the print head 3. At the purging and flushing processing (S22), a predetermined amount of ink is to be ejected. It is known how many times of ink ejection in printing is equivalent to the amount of ink to be ejected at the purging and flushing processing. Count values corresponding to the amount of ink to be ejected at the processing are prestored in the ROM 92 as a fixed value. Therefore, the CPU 91 counts the number of ejection times of the ink consumed at the processing and increments the count values to be stored in the corresponding counters 94*b* to 94*e*. After the purging or flushing processing (S22) has completed, flow proceeds to S13.

As a result of S13, when any of the first to fourth near-empty flags 94*f* to 94*i* of the ink cartridges 2 is on (S13: Yes), the CPU 91 determines whether the count value of the ink cartridge 2 whose near-empty flag is on is greater than or equal to the empty threshold value (S20). The ink level of the ink cartridge 2 whose near-empty flag is on cannot be detected by the ink sensor 19, so the CPU 91 detects that ink is empty by counting the number of times of ink ejection after the near-empty flag 94*f* to 94*i* is turned on.

When the count value of the ink cartridge 2 whose near-empty flag is on is lower than the empty threshold value (S20: No), the ink cartridge 2 still contains enough ink to perform printing. Therefore, flow proceeds to S19. After each processing is performed (S19), the ink detection processing is finished. As a result of S20, when the count value of the ink cartridge 2 whose near-empty flag is on is greater than or equal to the empty threshold value (S20: Yes), the CPU 91 executes ink empty processing to indicate that the ink is empty through the display or sound (S21). After the ink empty processing (S21) is completed, flow proceeds to S19. At S19, each processing, such as temporarily storing data that cannot be printed in the RAM 93, is performed, and then the ink detection processing is completed.

As a result of S14, when there is no count value that is greater than or equal to the predetermined value (e.g. 100) in the count values of the ink cartridges 2 whose near-empty flag is off (S14: No), flow proceeds to S19. When each processing of S19 has completed, the ink detection processing is completed.

As a result of S116, when the captured reflected light level is less than the first threshold value (S16: No), the ink level in the ink cartridge 2 is not near-empty. Therefore, flow skips S17 and moves to S18.

When an ink cartridge 2 is replaced with another ink cartridge 2 (detached and attached to the head unit 4) (the ink cartridge detection processing), the count value of the counter 94*b* to 94*e* corresponding to the replaced ink cartridge 2 is set to 0, and the corresponding counter 94*b* to 94*e* counts the number of ink ejection times thereafter. However, the replaced ink cartridge 2 is not always filled with the same amount of ink, because there may be cases, for example, where the ink cartridge 2 that has been used before for printing is attached or the ink cartridges 2 vary in production. Considering variations in an amount of ink to be ejected from the print head 3 of each color ink jet printer 1, the count values up to the near empty do not always become the same. Accordingly, if the number of times of ink ejection is continuously counted up from a start of using ink to when the ink is empty, then it becomes difficult to determine if the ink is empty at a certain threshold value (a predetermined count value), so that the ink-empty state, which is supposed to be detected at the predetermined count value, is likely to be determined unprecisely. However, at the time the near-empty is detected, it is conceivable that remaining amount of ink in ink cartridges 2 are almost the same, so that the number of times of ink ejection (count values) for consuming the remaining ink will be also the same. Therefore, the necessary number of times of ink ejection for consuming the remaining ink is referred to as the empty threshold value. The count is counted up to the empty threshold from 0, which is a point when the near-empty is detected (the near-empty flag 94*f* to 94*i* is turned on), and thus the ink-empty state can be precisely detected.

Figure 9:
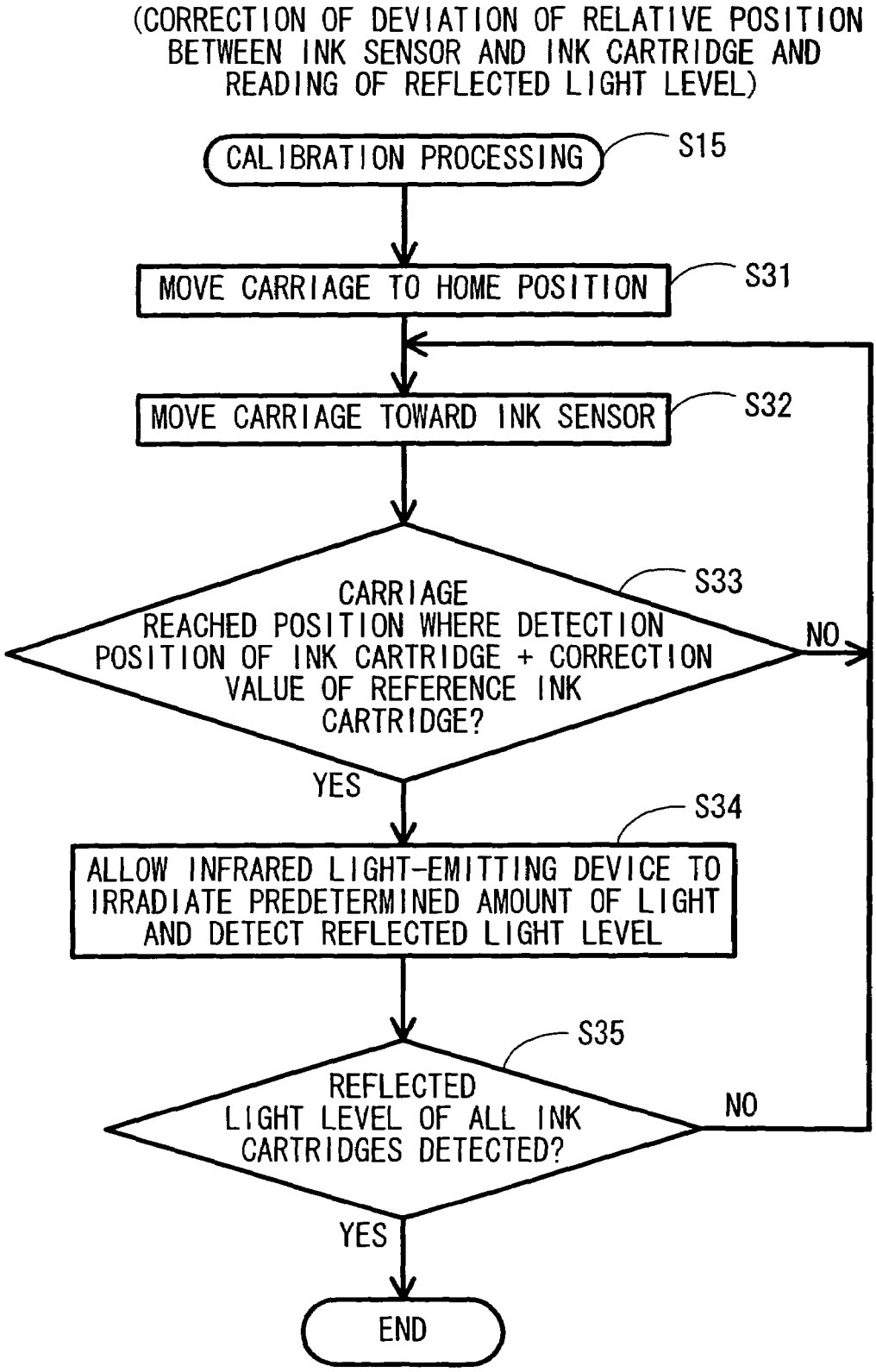
FIG. 9 is a flowchart of calibration processing to be executed during the ink detection processing of FIG. 8.

As shown in FIG. 9, at the calibration processing (S15), in order to detect the presence or absence of ink, a detection position of an ink cartridge 2 is corrected in accordance with a correction value stored in the calibration data memory 94*a* and a reflected light level (an amount of the reflected light) is captured at the corrected detection position.

At the calibration processing (S15), first, the CPU 91 moves the carriage 5 to its home position (S31), and then, further moves the carriage 5 toward the ink sensor 19 from the home position (S32). The CPU 91 determines whether the carriage 5 has reached a position where a correction value is added to a proper position of one of the ink cartridges 2 (S33). When the carriage 5 has reached the detection position where the correction value is added (S33: Yes), the CPU 91 allows the infrared light-emitting device 19*a* to irradiate a predetermined amount of light to detect a reflected light level (S34). Next, the CPU 91 determines whether the reflected light level is detected with respect to all four ink cartridges 2 (S35). When the reflected light levels of all the ink cartridges 2 are detected (S35: Yes), the calibration processing (S15) is finished.

On the other hand, as a result of S33, when the carriage 5 has not reached the detection position where the correction value is added to the proper detection position of the ink cartridge 2 (S33: No), flow returns to S32 and the CPU 91 moves the carriage 5 toward the ink sensor 19. As a result of S35, when the reflected light levels of all the ink cartridges 2 are not detected (S35: No), flow returns to S32. Until the reflected light levels of all the ink cartridges 2 are detected, the calibration processing (S15) is continued.

At the calibration processing (S15), the ink sensor 19 detects the amount of the reflected light (the reflected light level) reflected from a specific position of each ink cartridge 2. That is, the reflected light level is pinpoint data. Therefore, the amount of data to be processed can be reduced, thereby effectively performing data processing. Though the carriage 5 is moved at a high speed because the detection of the presence or absence of ink is performed during printing, each ink cartridge 2 is accurately transferred to the detection position based on the correction value stored in the calibration data memory 94*a*. Accordingly, the reflected light level can be precisely detected (even if it is point data).

As shown in FIG. 10, at the ink cartridge detection processing, the presence or absence of the ink cartridge 2 is detected. The ink cartridge detection processing is performed when the ink cartridge 2 is replaced. Detection of opening and closing of a cover by a sensor provided to the cover of the color ink jet printer 1 is regarded as the replacement of the ink cartridge 2.

At the ink cartridge detection processing, the CPU 91 determines whether the cover of ink jet printer 1 is closed after it was opened (S41). When the CPU 91 detects the closing of the cover, the CPU 91 executes the calibration processing (S15) to detect the reflected light level from the ink cartridge 2 at the predetermined detection position. Then, the CPU 91 determines whether the reflected light level of the ink cartridge 2 whose near-empty flag 94*f* to 94*i* is on is less than the first threshold value, that is, whether at least the sub-ink tank 45 is filled to capacity with the ink. When the reflected light level is less than the first threshold value (S43: Yes), it means that an ink cartridge 2, in which the ink level in the sub-ink tank 45 is low, is attached as a replacement, so that the near-empty flag 94*f* to 94*i* corresponding to the ink cartridge 2 is turned off (S44). Further, the count value of the counter 94*b* to 94*e* corresponding to the ink cartridge 2 is cleared (S45). Then, the CPU 91 determines whether the reflected light level that is greater than the second threshold value (the threshold value for detecting the absence of the ink cartridge) is detected at four positions (S46). When the reflected light level that is less than or equal to the second threshold value is detected at any position, the absence of the ink cartridge 2 is detected. Therefore, the ink cartridge absent error processing is performed such that the absence of the ink cartridge 2 is issued through the display or the sound (S47), and then the ink cartridge detection processing is finished.

As a result of S41, when the CPU 91 determines that the cover of the ink jet printer 1 is not closed (S41: No), the ink cartridge detection processing is finished. As a result of S43, when the reflected light level is equal to or greater than the first threshold value (S43: No), flow proceeds to S46. As a result of S46, when the reflected level that exceeds the second threshold value is detected at the four positions (S46: Yes), it means that all the four ink cartridge 2 are attached, so that the ink cartridge detection processing is finished.

Figure 11:
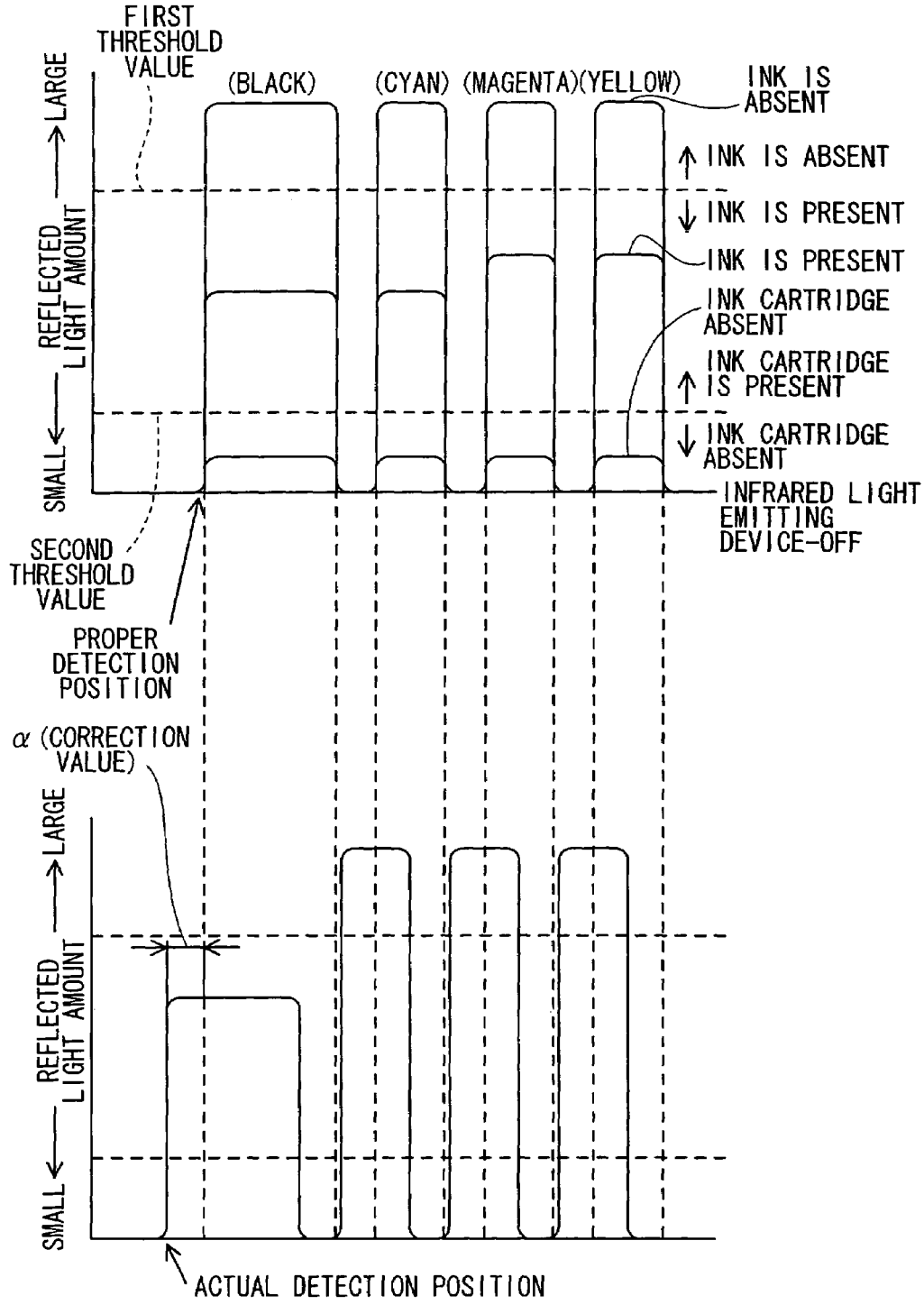
FIG. 11 is a schematic diagram showing an amount of change in reflected light from the ink cartridge.

As shown in FIG. 11, a vertical axis shows an amount of reflected light. The amount of the reflected light increases toward the upper end of the vertical axis. In FIG. 11, the first threshold for examining the absence of ink is indicated with a dashed line. When a reflected light level is greater than or equal to the first threshold value, it means that the ink is absent (near-empty). When the reflected light level is lower than the first threshold value, it means that the ink is present. A second threshold value for examining the absence of ink cartridges 2 is indicated with a dashed line under the first threshold value.

An, upper figure in FIG. 11 shows a theoretical reflected light level detected at a proper detection position. As shown in the figure, when an obtained reflected light level (signal waveform) is examined using the first threshold value, the presence or absence of ink can be detected. When the same reflected light level is examined using the second threshold value, the presence or absence of ink cartridges 2 can be detected. This examination method can be applied because the amount of reflected light between the presence and absence of ink and between presence and absence of an ink cartridge 2 is absolutely different.

A lower figure in FIG. 11 shows a signal waveform of a reflected light level detected at the calibration data input processing, when the ink sensor 19 is provided with deviation in a vertical direction against the irradiated surface of the ink cartridge 2. As can be seen from the figure, an actual detection position deviates leftward from the proper detection position. The head black ink cartridge 2*a* is to be used as a reference at the calibration processing. An amount of deviation $\alpha$ from the proper detection position of the black ink cartridge 2*a* is used as the correction value.

Next, a second embodiment will be described with reference to FIGS. 12A and 12B. While the ink cartridge 2 of the first embodiment has the reflector to change the optical path of the infrared light, an ink cartridge 130 of the second embodiment includes an infrared light-absorbing member 131 for absorbing irradiated infrared light. Like parts are indicated by the same reference numerals as the first embodiment, and explanations for those like parts will be omitted.

Figure 12A:
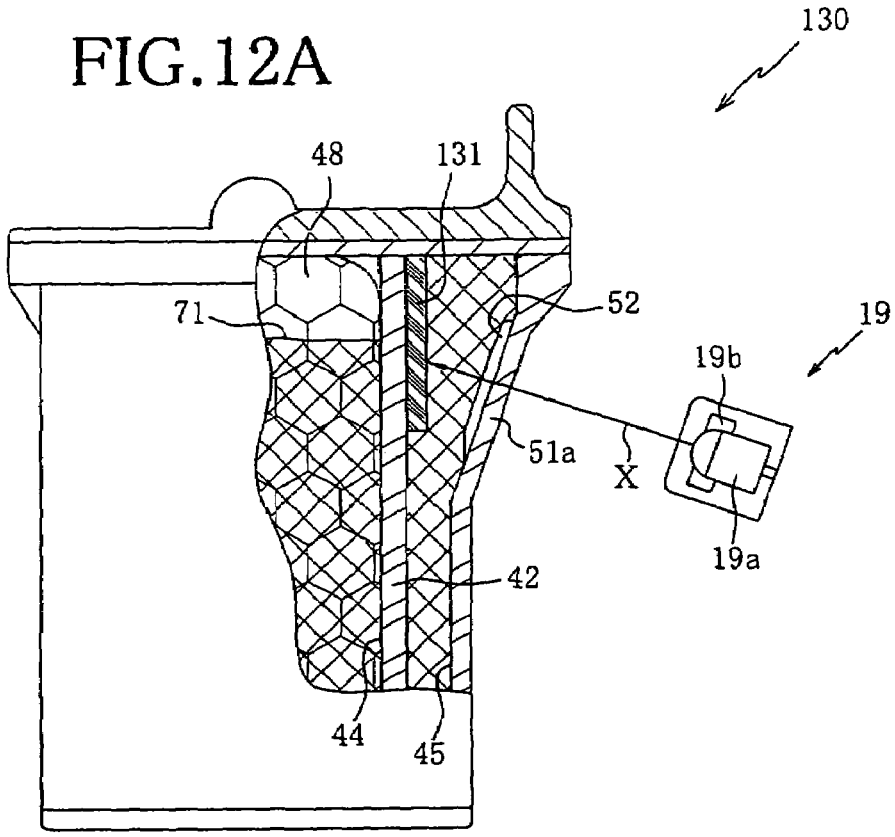
FIGS. 12A and 12B are side views of an ink cartridge and an ink sensor of a second embodiment.
Figure 12B:
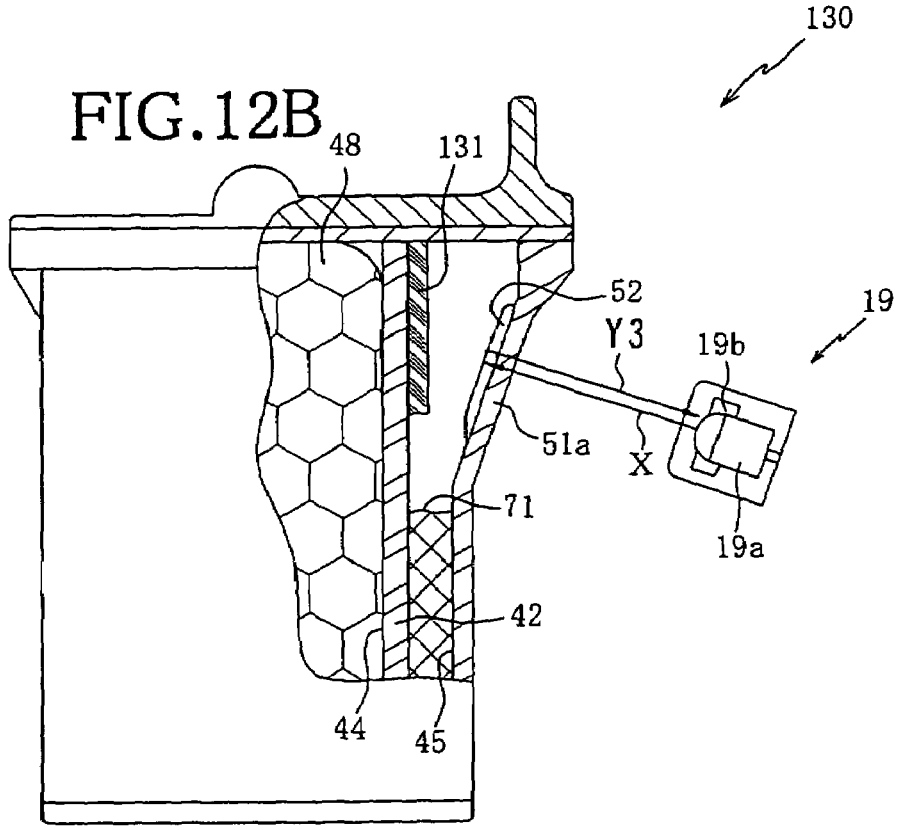

In FIGS. 12A and 12B, the head unit 4, the attaching member of the ink sensor 19, and the like are omitted.

As is the case with the first embodiment, the ink cartridge 130 has a plurality of prisms 52 on the inner surface (the surface that contacts the ink) of an inclined portion 51*a* to be irradiated with infrared light. A partition wall 42 partitions the inside of the ink cartridge 130 into a main ink tank 44 that accommodates a foam 48, and a sub-ink tank 45 that includes the infrared light-absorbing member 131 therein. The infrared light-absorbing member 131 absorbs infrared light passing through the ink cartridge 130 that was irradiated from the infrared light-emitting device 19*a*. The infrared light-absorbing member 131 is disposed in the sub-ink tank 45 so as to be opposed to the prisms 52 with a predetermined distance kept therebetween.

Next, a method for detecting the presence or absence of ink stored in the ink cartridge 130 having the infrared light-absorbing member 131 will be described. As in the case of the first embodiment, the ink sensor 19 irradiates infrared light toward the inclined portion 51*a* of the ink cartridge 130 from the infrared light-emitting device 19*a*. Then, the infrared light receptor 19*b* receives the reflected light. When the amount of the reflected light is smaller than or equal to a certain value, the CPU 91 determines that the ink is present in the ink cartridge 130 (FIG. 12A). When the amount of the reflected light is more than the certain value, the CPU 91 determines that the ink is absent in the ink cartridge 130 (FIG. 12B).

More specifically, when the sub-ink tank 45 is full of ink 71, as shown in FIG. 12A, the infrared light irradiated from the infrared light-emitting device 19*a* (optical path X) is absorbed by the infrared light-absorbing member 131. This happens because a refractive index of the material forming the inclined portion 51*a* (prisms 52) and that of the ink 71 is extremely close to each other, so that the infrared light passes through the ink 71 and travels within the ink cartridge 2. As the infrared light reaches the infrared light-absorbing member 131 in the sub-ink tank 45, the light is absorbed by the infrared light-absorbing member 131. Therefore, small amount of reflected light is to be received by the infrared light receptor 19*b* in the ink sensor 19 (the amount of the reflected light is less than or equal to the certain amount).

As with the first embodiment, the inclined portion 51*a* is inclined approximately 20 degrees with respect to the infrared light-absorbing member 131. If an infrared light-absorbing characteristic of the infrared light-absorbing member 131 deteriorates with time, for example, the infrared light-absorbing member 131 begins to reflect the infrared light. Even if this happens, in the embodiment, the infrared light that has reached the infrared light-absorbing member 131 is not reflected toward the inclined portion 51*a* (optical path X) because the inclined portion 51*a* is inclined as described above. Thus, the amount of the reflected light to be detected by the infrared light receptor 19*b* of the ink sensor 19, which has no relation to the ink level detection, can be restricted.

When only a half of the ink 71 is left in the sub-ink tank 45, as shown in FIG. 12B, the ink level is lower than the inclined portion 51. Therefore, the infrared light irradiated from the infrared light-emitting device 19*a* of the ink sensor 19 (the optical path X) is reflected off a phase boundary between the prisms 52 and air (the optical path Y3), because the refractive index of the material forming the inclined portion 51*a* (the prisms 52) is different from that of the air. Thus, a large amount of the reflected light is to be received by the infrared light receptor 19*b* in the ink sensor 19 (the amount of the reflected light exceeds the certain amount).

As described above, according to the ink cartridge 130 of the second embodiment, the infrared light-absorbing member 131 can absorb the infrared light that has no relation to the ink detection. The amount of the reflected light reflected from the inside of the ink cartridge 130 significantly changes according to the presence or absence of the ink. By detecting the difference of the amount of the light using the infrared light receptor 19*b* in the ink sensor 19, the presence of absence of the ink in the ink cartridge 130 can be precisely detected.

The inclined portion 51*a* (the prisms 52) and the infrared light-absorbing member 131 are disposed at the upper portion of the sub-ink tank 45. Thus, it can be determined that ink is absent before the ink 71 in the ink cartridge 130 runs out.

For the infrared light-absorbing member 131 described above, generally available well-known infrared light-absorbing members can be used. For example, the infrared light-absorbing member can be made of one of V (vanadium), Fe (iron), Cu (copper), Co (cobalt), or Ni (nickel), or varying combinations of those metals, using glass material as a base. The base material is not limited to a solid or liquid. For example, the base material may contain an infrared light absorbent, such as metal chelate compound of acetylacetone, anthraquinone compound, naphthoquinone compound, diaminedisethylenthiolatenickel derivative, aromatic diammine metal complex, aromatic dithiol metal complex, and aliphatic dithiol metal complex. The infrared light-absorbing member may have a filtering characteristic that allows the absorbing member to absorb light wavelengths within a particular area. It is preferable that an absorption coefficient of infrared light with a light wavelength of 700 nm to 900 nm is 90% or more.

Further, the inner wall of the main ink tank 44 and the inner wall of the sub-ink tank 45, that is other than the wall formed with the prisms 52, may have a coating that can absorb infrared light. Furthermore, the foam itself may be an infrared light-absorbing member.

An electrical construction of the color ink jet printer 1 of the second embodiment is the same as that of the color ink jet printer 1 of the first embodiment. Each processing performed in the color ink jet printer 1 of the second embodiment is also the same as that performed in the color ink jet printer 1 of the first embodiment. Therefore, those explanations will be omitted.

As described in each embodiment, according to the ink jet printer 1 of the invention, light is irradiated to the irradiated surface of the ink cartridge 2 at an angle and an amount of reflected light is detected by the ink sensor 19. Then, the absence of ink and the ink cartridge 2 can be detected by which a detected amount of reflected light is compared with a threshold for examining the absence of ink and a threshold for examining the absence of the ink cartridge 2. Thus, the presence or absence of the ink and the ink cartridge 2 can be correctly detected.

When the absence of ink or the absence of the ink cartridge 2 is examined, the position of the carriage 5 is corrected based on an error that is obtained from a deviation of an actual detection position from a theoretical (proper) detection position of the ink cartridge 2. Even when the actual detection position of the ink cartridge 2 by the ink sensor 19 is deviated from the proper detection position due to variations in attachment of the ink sensor 19, the deviation can be corrected. Accordingly, the amount of reflected light can be precisely detected.

According to the ink cartridge of the invention, when the ink level of an ink tank is not high up to an ink detection window, light irradiated toward the ink detection window by a light-emitting device provided in the image forming apparatus is reflected at an inner surface of the ink detection window and the reflected light travels toward a photoreceptor provided in the image forming apparatus. Accordingly, a large amount of the reflected light can be received by a photoreceptor provided in the image forming apparatus. When the ink level in the ink tank is high up to the ink detection window, the light permeates a phase boundary between the ink and the ink detection window. Then, the light travels in the ink tank, passing through the ink, and reaches an optical path direction changing member disposed in the ink tank. The direction of the optical path of the light that reaches the optical path direction changing member is changed by the optical path direction changing member. The ink detection window is inclined at a predetermine angle with respect to the optical path direction changing member, so that an incident angle of the light to the optical path direction changing member is different from an incident angle of the light to the ink detection window. Accordingly, the light that travels toward the photoreceptor provided in the image forming apparatus is regulated. Thus, a small amount of the reflected light can be received by the photoreceptor provided in the image forming apparatus. As described above, a great difference occurs in the amount of the reflected light between presence and absence of the ink. Consequently, incorrect detection of the presence or absence of the ink by the photoreceptor provided in the image forming apparatus can be restricted, and the detection accuracy of the presence or absence of the ink can be improved.

According to the ink cartridge of the invention, the optical path direction changing member is disposed on the optical path of the light that passes through the ink detection window into the ink tank and travels toward a porous member. Therefore, when the ink level in the ink tank is high up to the ink detection window, the direction of the optical path can be changed by the optical path direction changing member prior to being reflected by the porous member. Thus, the light that passes through the ink tank is reflected by the porous member and the reflected light received by the photoreceptor provided in the image forming apparatus can be restricted.

According to another ink cartridge of the invention, when the sub-ink tank contains the ink, the direction of the optical path of the light that passes though the ink in the sub-ink tank can be changed by the optical path direction changing member prior to being reflected by the main ink tank accommodating the porous member. Accordingly, the light that passes through the sub-ink tank is reflected by the main ink tank accommodating the porous member and the reflected light received by the photoreceptor provided in the image forming apparatus can be restricted.

According to another ink cartridge, a plurality of prisms are provided on the surface of the ink detection window that contacts the ink, so that the light irradiated toward the ink detection window can be effectively reflected toward the photoreceptor provided in the image forming apparatus when the ink becomes empty. Further, the prisms are formed in a direction for preventing the ink from remaining thereon, so that the ink remaining on the prisms can be minimized. Also, when the ink tank becomes empty, an incorrect determination (such that the ink tank contains the ink due to the ink remaining on the prisms although the ink tank is actually empty), can be prevented.

According to another ink cartridge, the ink detection window is inclined between approximately 15 degrees and 25 degrees with respect to the optical path direction changing member. That is, when the ink detection window is inclined approximately 15 degrees or greater with respect to the optical path direction changing member, the amount of light to be reflected from the optical path direction changing member toward the photoreceptor can be restricted. Further, when the angle of the inclination is approximately 25 degrees or smaller, the ink can be prevented from always collecting on the prisms.

According to another ink cartridge, the optical path direction changing member is pouched, made of a light permeable member, and contains air therein, so that the direction of the optical path that passes through the optical path direction changing member can be changed at the phase boundary between the ink and air, due to the difference of the refractive index between the ink and air. Thus, it can be restricted that the light that passes through the ink tank is reflected by the porous member and the reflected light is received by the photoreceptor provided in the image forming apparatus.

According to another ink cartridge, a partition wall provided in the ink tank is an optical path direction changing member, so that it is unnecessary to provide the optical path direction changing member separately. Therefore, the number of parts can be reduced, and further, the manufacturing costs of the ink cartridge can be reduced.

According to another ink cartridge, the optical path direction changing member is a reflective wall that reflects the light that passes through the ink detection window. Thus, it can be restricted that the light that passes through the ink tank is reflected by the porous member and the reflected light is received by the photoreceptor provided in the image forming apparatus when the ink level in the ink tank is high up to the ink detection window.

While the invention has been described in detail with reference to specific embodiments thereof, it would be apparent to those skilled in the art that various changes and modifications may be made therein without departing from the spirit of the invention. For example, in the first embodiment, the surface of the inclined portion 51*a* is inclined approximately 20 degrees with respect to the opposed surface of the reflector 53. However, it is not limited to the first embodiment. The reflector 53 can be disposed with being inclined with respect to the inclined surface 51, instead of inclining the inclined surface 51. If this structure is implemented, the same effects as those obtained in the first embodiment can be obtained.

Figure 15:
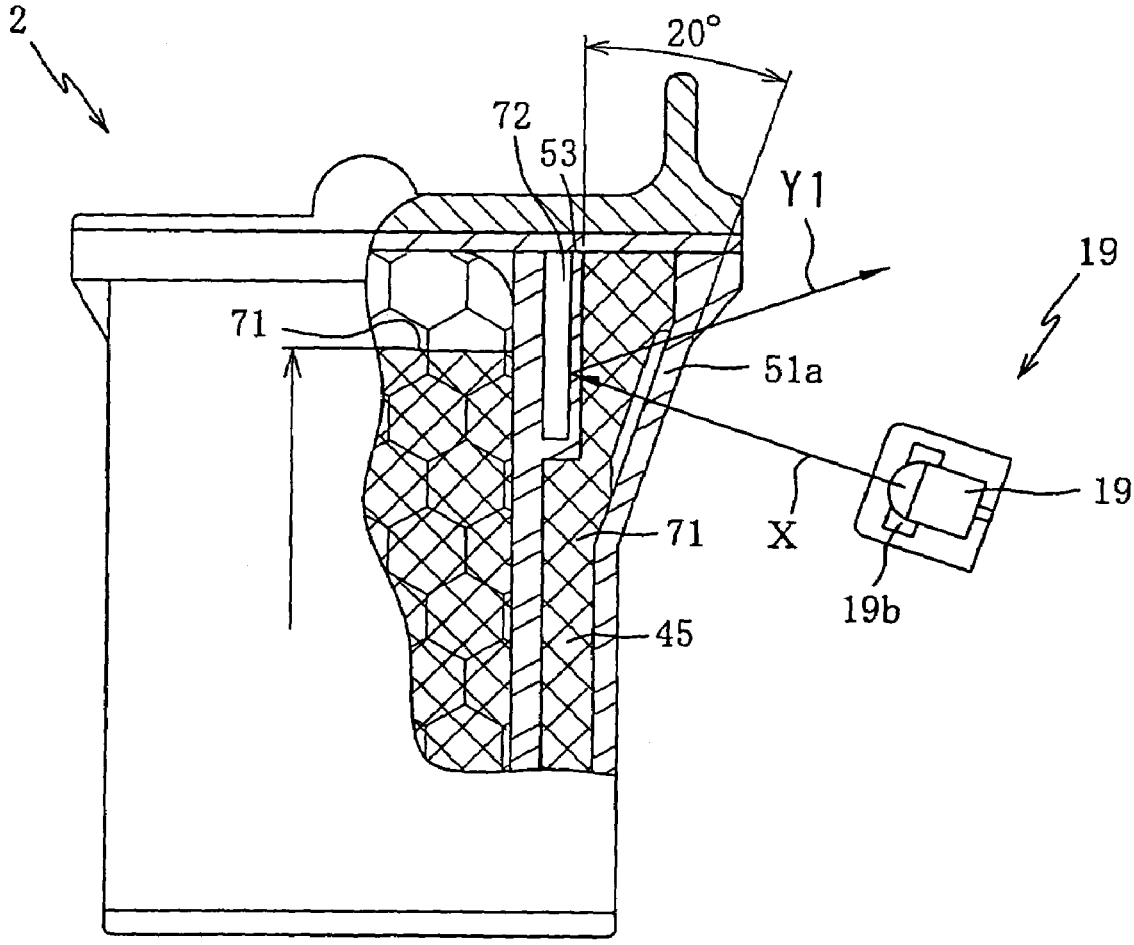
FIG. 15 is a side view of a modified ink cartridge of a first embodiment.

In the first embodiment, the reflector 53 is pouched so as to contain air therein. With this structure, the light that has reached the reflector 53 is reflected. However, as long as the light that has reached the reflector 53 can be reflected, the reflector 53 can be a reflecting plate. Although the reflector 53 is separately provided in the sub-ink tank 45, as shown in FIG. 15, the partition wall 42 that separates the main ink tank 44 and the sub-ink tank 45 can be a reflector.

Figure 13A:
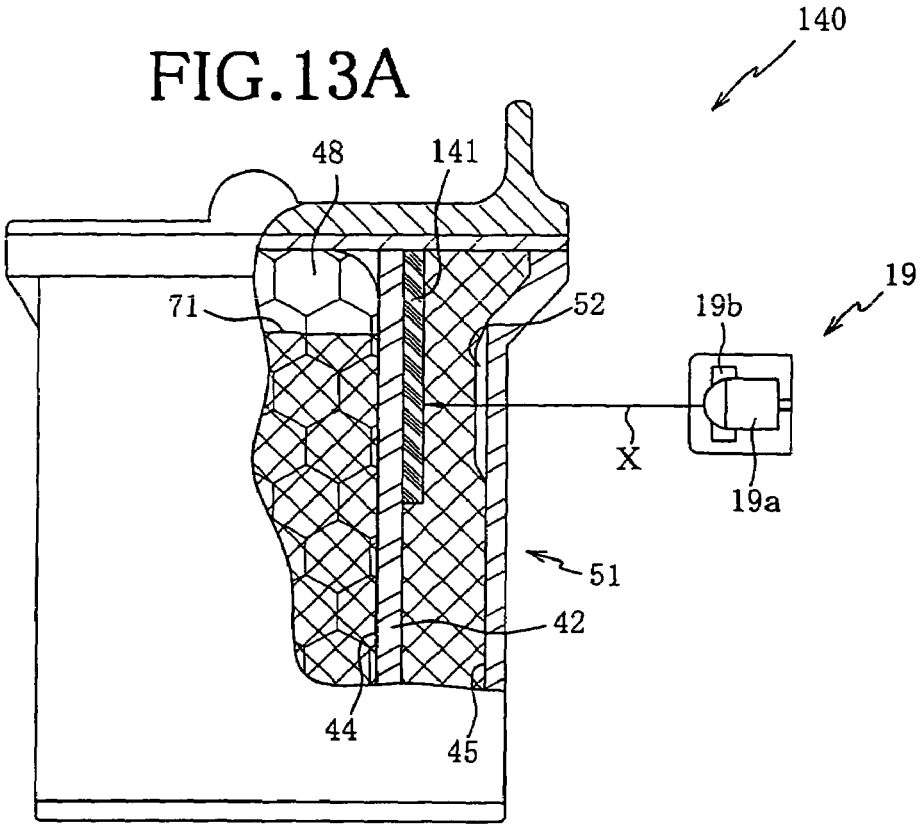
FIGS. 13A and 13B are side views of the ink cartridge and the ink sensor of the second embodiment.
Figure 13B:
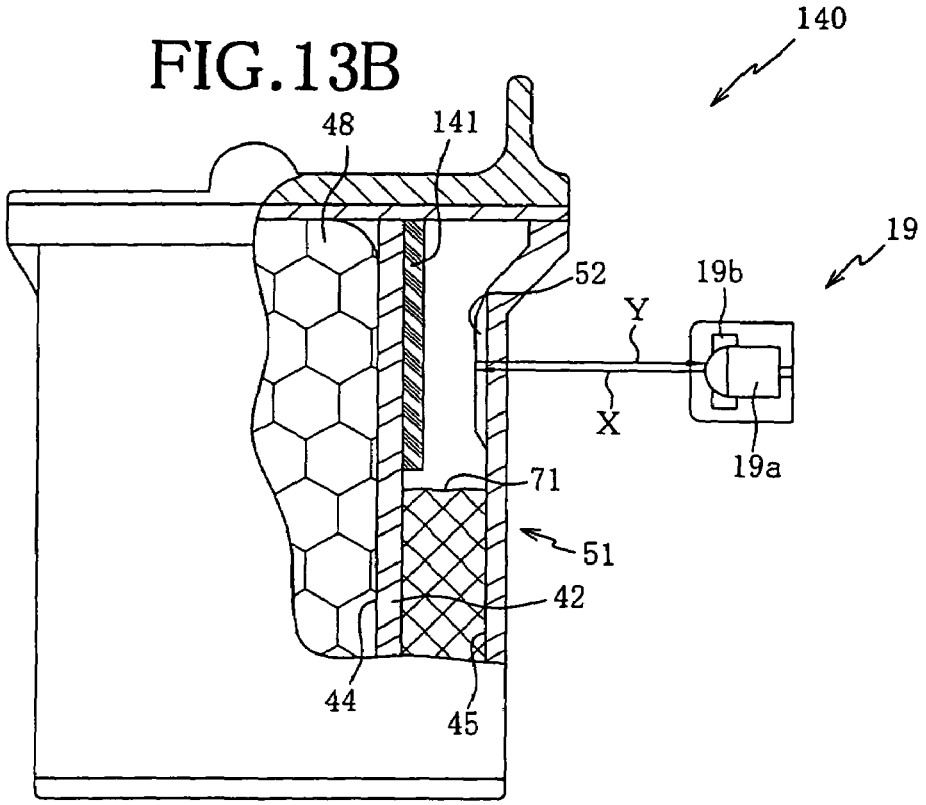

In the second embodiment, the inclined portion 51*a* to be irradiated by infrared light is inclined with respect to the infrared light-absorbing member 131. However, the inclined portion 51*a* may be provided parallel to the infrared light-absorbing member 131. That is, as shown in FIGS. 13A and 13B, the side wall 51 is vertically provided when viewed from the side of an ink cartridge 140 and an infrared light-absorbing member 141 is disposed parallel to the side wall 51 (the prisms 52) in the ink cartridge 140. The principal of the detection of the presence or absence of the ink in the ink cartridge 140 will be omitted since it is similar to that applied to the ink cartridges 2, 130 described above. In this case, also, the presence or absence of the ink can be precisely detected by which the infrared light-absorbing member 141 is disposed on the optical path X of the infrared light to be irradiated from the infrared light-emitting device 19*a*. In this case, also, the ink sensor 19 is disposed with its light-emitting surface turned approximately 10 degrees in the horizontal direction with respect to the ink cartridge 140.

In the second embodiment, the partition wall 42 or the foam 48 may be structured as an infrared light-absorbing member. Further, the infrared light-absorbing members 131, 141 may be accommodated in the pouched reflector 53 described in the first embodiment. In this case, the infrared light-absorbing members 131, 141 can be disposed in the ink cartridge while separated from the ink 71. Accordingly, the infrared light-absorbing members 131, 141 can be made of material sensitive to ink or that affecting the ink, for example. Further, the infrared light-absorbing member can be liquid because the pouched reflector 53 can hermetically enclose the infrared light-absorbing member therein.

In the embodiments described above, the color ink jet printer 1 is used as an image forming apparatus. However, the invention is not restricted to the specific embodiments. For example, the invention can be applied to an ink jet type copying machine and facsimile machines. In the embodiments, four ink cartridges 2 are attached to the color ink jet printer 1. However, the ink jet printer 1 may be structured so that a predetermined number of ink cartridges, at least one, can be attached.

In each embodiment described above, at the calibration data input processing, a correction value for correcting a deviation of an actual detection position from a proper detection position is calculated based on a reference ink cartridge 2. At the calibration processing (S15), the position of the ink cartridges 2 are corrected according to the correction value of the reference ink cartridge 2. Instead of this, a correction value may be obtained with respect to each ink cartridge 2 or correction values of head and last ink cartridges 2 may be obtained. The position of the ink cartridge 2 may be corrected based on the correction value obtained as described above. As a result, the amount of the reflected light can be further precisely detected in a proper position.

In each embodiment described above, each of the ink cartridges 2 is provided with a single counter (the first to fourth counters 94*b* to 94*e*). At the ink detection processing, the counters 94*b* to 94*e* count a time interval of ink detection. When any of the near-empty flags 94*f* to 94*i* is turned on, the counter value of the counter 94*b* to 94*e* corresponding to the near-empty flag 94*f* to 94*i* that is on is cleared to 0, and the number of ink ejection is counted up to an empty threshold value. However, two counters may be provided for each ink cartridge 2. At the ink detection, in this case, one counter may count the total number of times of ink ejection from a first election to when the ink is empty, and another may count a time interval of ink detection based on the number of times of ink ejection.

When the invention is applied to a facsimile device, the detection of a remaining amount of ink is extremely effective if performed before printing is started. That is, the facsimile device may delete received facsimile data after printing the data on a recording sheet. Thus, avoiding the situation where the facsimile device performs printing of received facsimile data on the recording sheet without ink, wherein the facsimile device may delete the data, determining that the data is already printed, before the user actually receives the information.

Figure 14:
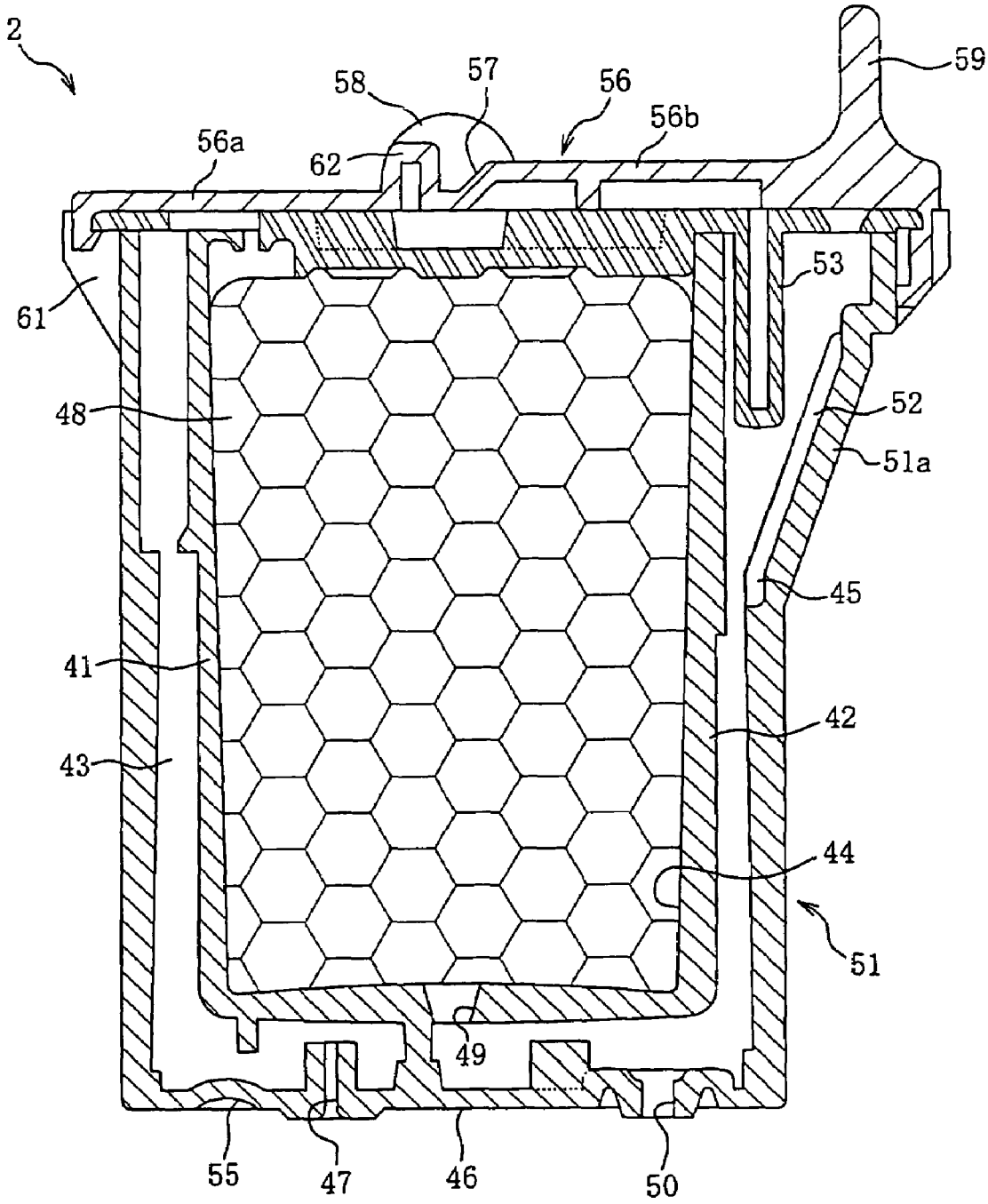
FIG. 14 is a side view of an ink cartridge of a third embodiment.

A third embodiment of an ink cartridge 2 is shown in FIG. 14. As shown in FIG. 14, prisms 52 is formed on the inner surface of the inclined portion 51*a* so as to extend to a vertical wall continuing into the inclined portion 51*a*. In this case, the ink 71 can be effectively prevented from remaining on the prisms due to the surface tension of the ink because lower ends of the prisms 52 is not formed on the inclined portion 51*a*. Thus, the presence or absence of the ink can be further precisely detected.

What is claimed is:

1. An ink cartridge, comprising:

an ink tank that stores ink;

a panel disposed in an outer wall surface of the ink tank, the panel being formed of a material that is capable of transmitting light; and an optical path direction changing member that is disposed inside the ink tank, at a predetermined distance away from a surface of the panel that is capable of contacting the ink;

wherein:

if light passes through the panel, the optical path direction changing member changes a direction of an optical path of the light; and the panel is inclined at a predetermined angle with respect to the optical path direction changing member.

2. The ink cartridge of claim 1, further comprising a porous member that is accommodated in the ink tank and is capable of absorbing the ink, wherein the optical path direction changing member is positioned between the panel and the porous member.

3. The ink cartridge of claim 2, wherein the ink tank is separated into a main ink tank including the panel and a sub-ink tank including a partition wall accommodating the porous member, the optical path direction changing member being provided near the partition wall.

4. The ink cartridge of claim 3, wherein the optical path changing member is provided in the partition wall.

5. The ink cartridge of claim 3, wherein the panel is provided in an outer surface of the main ink tank.

6. The ink cartridge of claim 1, wherein the panel includes a plurality of prism-shaped structures on the surface of the panel that is capable of contacting the ink, wherein the prism-shaped structures are configured to prevent the ink from collecting thereon.

7. The ink cartridge of claim 1, wherein the predetermined angle is between about 15 and about 25 degrees.

8. The ink cartridge of claim 1, wherein the optical path direction changing member has a pouch structure formed of a material that is capable of transmitting light and the pouch structure contains air.

9. The ink cartridge of claim 1, wherein the optical path direction changing member includes at least one surface that is capable of reflecting light.

10. The ink cartridge of claim 1, wherein the optical path direction changing member includes at least one surface that is capable of absorbing light.

11. A printing apparatus capable of mounting the ink cartridge of claim 1, the printing apparatus comprising:

an irradiator that irradiates the panel with light;

a photoreceptor that receives reflected light of the light irradiated by the irradiator; and a controller that determines at least one of the presence or absence of the ink and the presence or absence of the ink cartridge, in accordance with an amount of the reflected light received by the photoreceptor.

12. The printing apparatus of claim 11, wherein the irradiator and the photoreceptor form an ink sensor.

13. The printing apparatus of claim 12, wherein the ink sensor includes a light-emitting surface turned about 10 degrees in a horizontal direction with respect to the panel, when the ink cartridge is installed in the printing apparatus.

14. An ink detection method for detecting an amount of ink remaining in the ink cartridge of claim 1, comprising:

irradiating the panel with light;

receiving reflected light from the ink cartridge; and determining at least one of the presence or absence of the ink and the presence or absence of the ink cartridge, according to an amount of the reflected light received.

15. The ink cartridge of claim 1, wherein the surface of the panel that is capable of contacting the ink is an inner surface.

16. An ink cartridge, comprising:

an ink tank that stores ink;

a porous member that can absorb the ink stored in the ink tank;

a partition wall that separates the ink tank into an area that accommodates the porous member and another area; and a panel formed of a material capable of transmitting light disposed in an outer wall surface of the ink tank;

wherein, if light passes through the panel, a preventive member that is disposed inside the tank and prevents the light from being reflected off the partition wall or the porous member and passing back through the panel.

17. The ink cartridge of claim 16, wherein the preventive member is an optical path direction changing member.

18. The ink cartridge of claim 16, wherein the preventive member is formed of a material that is capable of absorbing light.

19. The ink cartridge of claim 18, wherein the preventive member includes a light-absorbing coating.

20. The ink cartridge of claim 18, wherein the preventive member includes a light-absorbing foam.

21. The ink cartridge of claim 18, wherein the panel of the ink cartridge is inclined with respect to the preventive member.

22. The ink cartridge of claim 18, wherein a surface of the panel is parallel to a surface of the preventive member.

23. The ink cartridge of claim 16, wherein the preventive member has a pouch structure formed of a material that is capable of transmitting light and the pouch structure contains air.

24. The ink cartridge of claim 23, wherein the pouch structure further contains a light-absorbing member.

25. An ink cartridge, comprising:

an ink tank that stores ink;

a panel formed of a material that is capable of transmitting light disposed in an outer wall surface of the ink tank;

an optical path direction changing member that is disposed inside the ink tank, at a predetermined distance away from a surface of the panel that is capable of contacting the ink; and a porous member accommodated in the ink tank that is capable of absorbing the ink;

wherein:

if light passes through the panel, the optical path direction changing member changes a direction of an optical path of the light;

the panel is inclined at a predetermined angle with respect to the optical path direction changing member;

the optical path direction changing member is positioned between the panel and the porous member;

the ink tank is separated into a main ink tank including the panel and a sub-ink tank including a partition wall accommodating the porous member, the optical path direction changing member being provided near the partition wall; and the optical path direction changing member has a pouch structure formed of a material that is capable of transmitting light and the pouch structure contains air.

26. The ink cartridge of claim 25, wherein the predetermined angle is between about 15 and about 25 degrees.

* * * * *